US011161159B2

(12) United States Patent
Bish et al.

(10) Patent No.: US 11,161,159 B2
(45) Date of Patent: Nov. 2, 2021

(54) AUTOMATED CAN HEIGHT ADJUSTMENT SYSTEM AND ASSOCIATED METHOD

(71) Applicant: Armor Metal Group, Inc., Cincinnati, OH (US)

(72) Inventors: Michael P. Bish, Hebron, KY (US); James W. Kelley, Aurora, IN (US); Andrew S. Brodbeck, Cincinnati, OH (US); Michael W. Leming, Loveland, OH (US); Robert A. Deakin, South Lebanon, OH (US); Pavel Bronshteyn, Mason, OH (US); Douglas Jones, Morrow, OH (US); Shaun D. Davenport, Springboro, OH (US)

(73) Assignee: Armor Metal Group, Inc., Cincinnati, OH (US)

( * ) Notice: Subject to any disclaimer, the term of this patent is extended or adjusted under 35 U.S.C. 154(b) by 97 days.

(21) Appl. No.: 16/856,408

(22) Filed: Apr. 23, 2020

(65) Prior Publication Data

US 2020/0246847 A1 Aug. 6, 2020

Related U.S. Application Data

(62) Division of application No. 15/903,741, filed on Feb. 23, 2018, now Pat. No. 10,702,900.

(60) Provisional application No. 62/463,141, filed on Feb. 24, 2017.

(51) Int. Cl.

| | |
|---|---|
| ***B08B 9/42*** | (2006.01) |
| ***B08B 9/20*** | (2006.01) |
| ***B08B 3/02*** | (2006.01) |

(52) U.S. Cl.

CPC ..... *B08B 9/423* (2013.01); *B08B 3/022* (2013.01); *B08B 9/205* (2013.01); *B08B 9/42* (2013.01)

(58) Field of Classification Search

CPC B08B 9/423; B08B 9/209; B08B 9/42; B08B 3/022

USPC ..... 134/61

See application file for complete search history.

(56) References Cited

FOREIGN PATENT DOCUMENTS

DE 4200689 A1 7/1993

OTHER PUBLICATIONS

DE4200689A1—machine translation (Year: 1993).*

* cited by examiner

*Primary Examiner* — Tinsae B Ayalew

(74) *Attorney, Agent, or Firm* — Wood Herron & Evans LLP

(57) ABSTRACT

An automated can adjustment system for a can cleaning system and associated method is disclosed. The automated can adjustment system can store different stage height information corresponding to various cans with different heights in a controller. The stage height information corresponding to the different can heights is associated with and recallable by various preset buttons operatively coupled with the controller. The controller is configured to communicate with the one or more drive mechanisms to adjust one or more stage heights based on the stage height information recalled when a particular preset button is selected. Different stage heights may be changed by then selecting a different preset button associated with a can having a different height.

5 Claims, 17 Drawing Sheets

402
414b
414b 404
416
426c
410c
416
414a 418a
416
416
416
414b 7B
124
414a
426c
420
416
426a
410a
7C
7A
426d
422
420
410d
416
401
400
414c
416
416
410b
416
418b
426b
422
430
414b
420
422
420
124

AUTOMATED CAN HEIGHT ADJUSTMENT SYSTEM AND ASSOCIATED METHOD

CROSS REFERENCE TO RELATED APPLICATIONS

This application is a divisional of U.S. patent application Ser. No. 15/903,741 filed Feb. 23, 2018 (pending), which claims the benefit of priority to U.S. Provisional Patent Application Ser. No. 62/463,141, filed on Feb. 24, 2017, the entire disclosures of which are hereby incorporated by reference herein.

TECHNICAL FIELD

This application relates generally to systems and methods for adjusting the height of a conveying system. More specifically, this application describes systems and methods of adjusting the height of food and beverage container belts/conveyors in a repeatable and accurate manner.

BACKGROUND OF THE INVENTION

In the two-piece container industry for food and beverages, cans are generally constructed by merging metal cups with corresponding lids. Because of the metal (e.g. aluminum and steel) construction of these cans, a special chemical cleaning process is generally used to ensure the cans are suitable for storing food and beverages. The cleaning process is performed by a can cleaning system that generally includes a washer and a dry-off oven. The can washer generally includes several stages: (1) one or more hold down belts that prevent cans from being blown upwards, (2) one or more belt stripper/blow-off stages, (3) one or more blow-off nozzle stages, (4) vacuum or magnetic transfer stage, and (5) one or more jam detector stages. The dry-off oven generally includes a heat chamber with a height adjustable dryer plenum. It is desirable that each of these stages be adjustable to accommodate and allow for proper operation with a specific sized can.

Currently, the method of making adjustments to these stages require manually adjusting a mechanical lever or hand crank for each stage to accommodate various sized cans. This manual adjustment generally requires the use of multiple machine operators, and takes hours to properly set the height for a desired can size and is not easily repeatable. What is needed is a system and method that can be used to adjust the different stages of the can washer and/or dry-off oven with a single machine operator and in a repeatable and accurate manner.

SUMMARY

To address these and other shortcomings, an automated can adjustment system for a can cleaning system is disclosed. The can cleaning system includes at least a first stage that is adjustable to accommodate at least a first can having a first can height and a second can having a second can height. The automated can adjustment system includes a first drive mechanism configured to be operatively coupled with the first stage to enable the first stage to adjust a first stage height corresponding to the first can height and the second can height. The automated can adjustment system further includes a first height sensing device operatively coupled with the first drive mechanism, wherein the first height sensing device is configured to sense a first stage height corresponding to each of the first can height and the second can height, and wherein the first height sensing device is configured to generate first stage height information for the first stage corresponding to each of the first can height and the second can height. The automated can system further includes a controller in communication with the first drive mechanism and the first height sensing device, the controller operatively coupled to a first preset button and a second preset button. The controller is configured to receive the first stage height information from the first height sensing device and to store the first stage height information corresponding to each of the first can height and the second can height, the first stage height information corresponding to the first can height being associated with and recallable by the first preset button and the first stage height information corresponding to the second can height being associated with and recallable by the second present button. The controller is configured to communicate with the first drive mechanism to adjust the first stage height based on the first stage height information recalled when either the first preset button or the second preset button is selected.

The can cleaning system above may further include at least a second stage that is adjustable to accommodate at least the first and second cans. In that configuration, the automated can adjustment system further includes a second drive mechanism configured to be operatively coupled with the second stage to enable the second stage to adjust a second stage height corresponding to the first can height and the second can height. The automated can adjustment system further includes a second height sensing device operatively coupled with the second drive mechanism, wherein the second height sensing device is configured to sense a second stage height corresponding to each of the first can height and the second can height, and wherein the second height sensing device is configured to generate second stage height information for the second stage corresponding to each of the first can height and the second can height. The controller is also in communication with second drive mechanism and the second height sensing device. The controller is also configured to receive the second stage height information from the second height sensing devices and to store the second stage height information corresponding to each of the first can height and the second can height, the second stage height information corresponding to the first can height being associated with and recallable by the first preset button and the second stage height information corresponding to the second can height being associated with and recallable by the second preset button. The controller is also configured to communicate with the second drive mechanism to change the second stage height based on the second stage height information recalled when either the first preset button or the second preset button is selected.

A method for adjusting the height of a can cleaning system using the automated can height adjustment system is also disclosed. The method includes providing a first stage having a first stage height that is adjustable to accommodate at least a first can having a first can height and a second can having a second can height and providing the automated can adjustment system that includes a first drive mechanism configured to be operatively coupled with the first stage, a first height sensing device operatively coupled with the first drive mechanism, and a controller in communication with the first drive mechanism and the first height sensing device. The method includes sensing a first stage height corresponding to the first can height using the first height sensing device; generating first stage height information for the first stage corresponding to the first can height; receiving the first stage height information corresponding to the first can height from the first height sensing device to the controller; associating the first stage height information corresponding to the first can height with a first preset button; recalling the first stage height information corresponding to the first can height by selecting the first preset button; and adjusting the first stage height based on the first stage height information corresponding to the first can height, wherein the controller instructs the first drive mechanism to adjust the first stage height to correspond to the first can height.

In another embodiment, the method includes associating the first stage height information corresponding to a second can height with a second preset button; recalling the first stage height information corresponding to the second can height by selecting the second present button; and adjusting the height of the first stage based on the first stage height information corresponding to the second can height, wherein the controller instructs the first drive mechanism to adjust the first stage height to correspond to the second can height.

In another embodiment, the method for adjusting the height of a can cleaning system is contemplated for a system having a first and second stage and the height of both first and second stages being adjustable to correspond to a first can height be selecting a preset button associated with the height of the first can.

Various additional features and advantages of the invention will become more apparent to those of ordinary skill in the art upon review of the following detailed description of one or more illustrative embodiments taken in conjunction with the accompanying drawings.

BRIEF DESCRIPTION OF THE DRAWINGS

The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

Figure 1A:
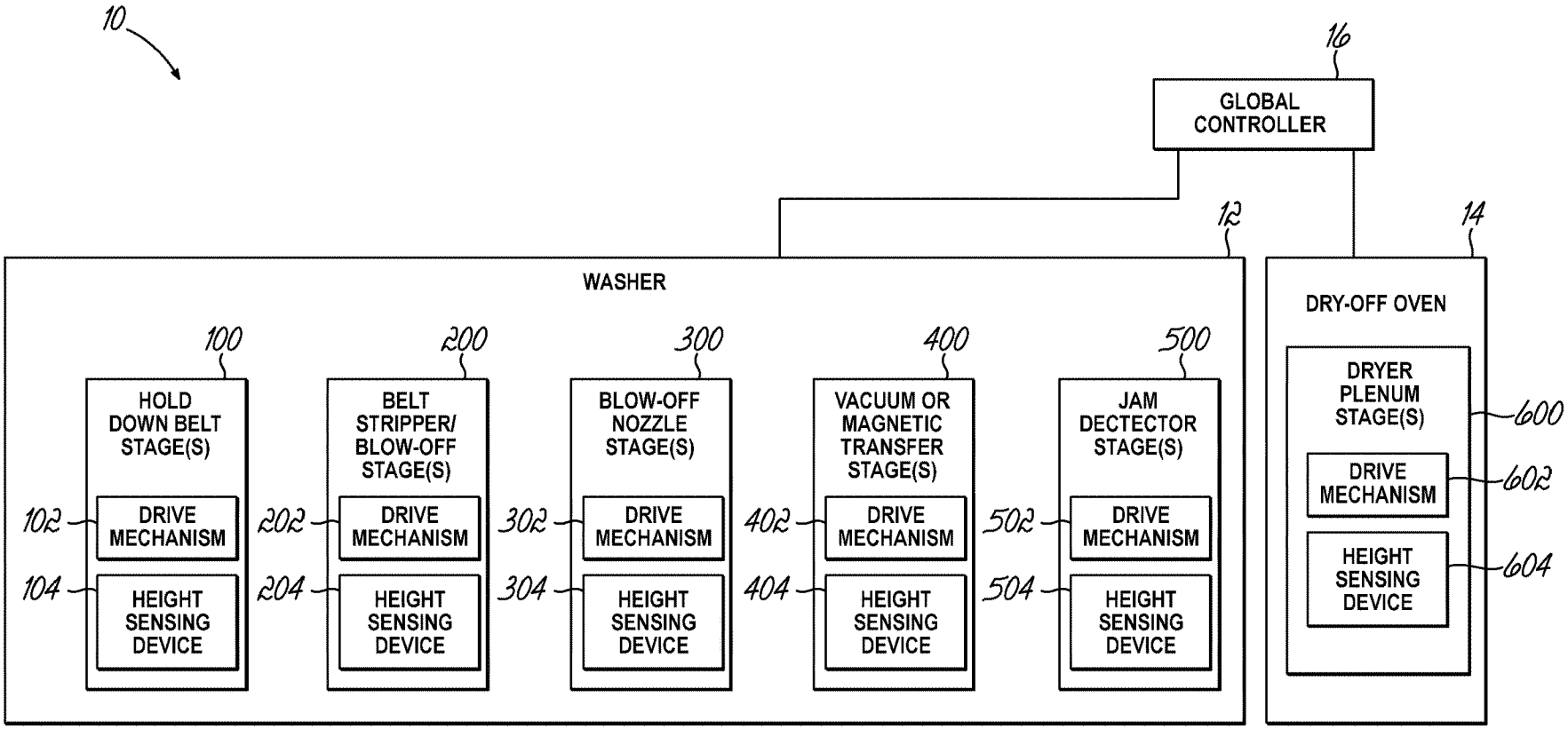
FIG. 1A shows a block diagram of an exemplary automated can height adjustment system with a can cleaning system that includes a washer with multiple stages and a dry-off oven with a single stage, where the height of each stage may be adjusted using a global controller.
Figure 1B:
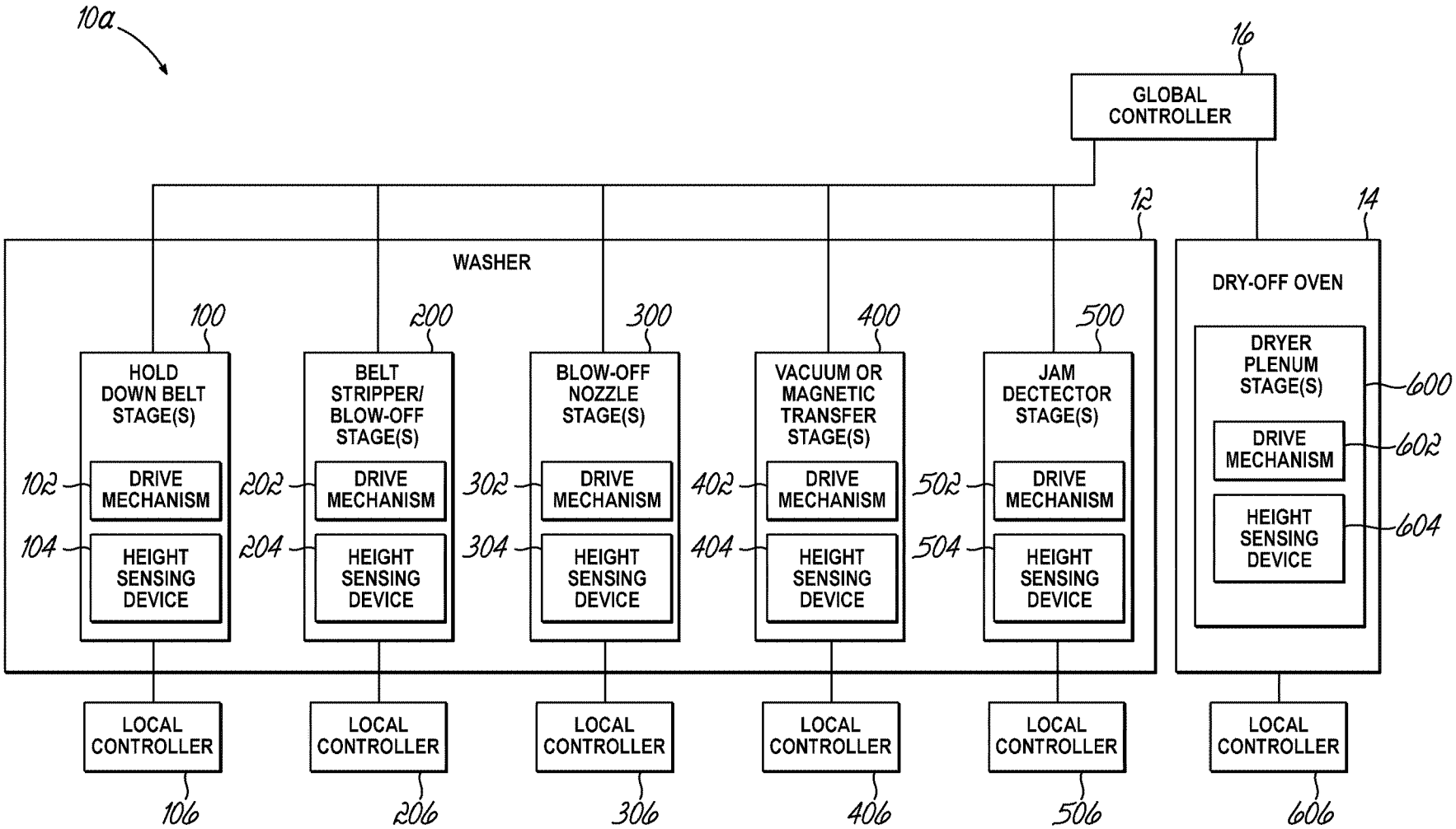
FIG. 1B shows a block diagram of another exemplary automated can height adjustment system operatively coupled with a can cleaning system that includes a washer with multiple stages and a dry-off oven with a single stage, where the height of each individual stage is adjusted using the global controller and/or local controller(s) in communication with a particular stage.
Figure 2:
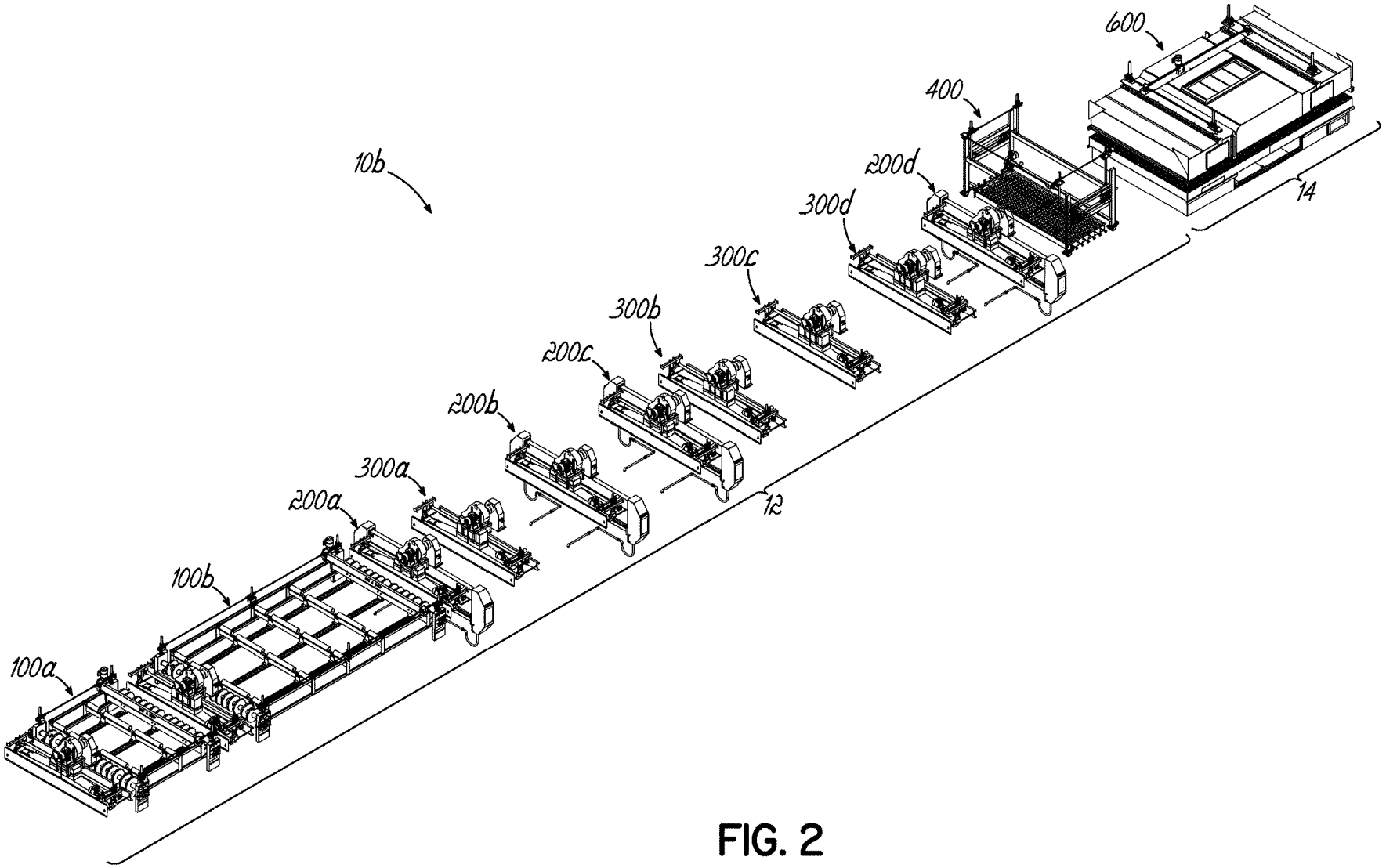
FIG. 2 shows perspective view of an exemplary automated can height adjustment system operatively coupled with a can cleaning system, the can cleaning system including a washer with multiple stages and a dry-off oven with a single stage.

With reference to FIGS. 1A, 1B, and 2, the automated can height adjustment system 10, 10*a*, 10*b* adjusts one or more stages of a can cleaning system as described herein through various exemplary embodiments. The can cleaning system includes at least a first stage (e.g. a washer 12 and/or a dry-off oven 14) that is adjustable to accommodate at least first and second cans having different can heights using a global controller 16. As shown in FIG. 1A, the global controller 16 is in communication with the washer 12 and the dry-off oven 14. This automated can height adjustment system 10, 10*a*, 10*b* offers high system repeatability when switching between different can sizes compared to the existing operator-to-operator variability that is inefficient and imprecise.

As shown in FIGS. 1A and 1B, the stages may include a hold down belt stage(s) 100, a belt stripper/blow-off stage(s) 200, a blow-off nozzle stage(s) 300, a vacuum or magnetic transfer stage(s) 400, a jam detector stage(s) 500, and a dryer plenum stage 600 to adapt to various different can sizes in minutes with a single machine operator. The automated can height adjustment system 10, 10*a*, 10*b* may include more or less stages if desired, and these stages are merely intended to show an exemplary non-limiting embodiment.

For the sake of clarity and brevity in this Detailed Description, as used herein, the first stage is intended to refer to any stage of the can cleaning system, while the second stage is intended to refer to any stage that occurs subsequent to, or downstream of, the first stage. In other words, at least part of the first stage occurs prior to the start of the second stage.

An exemplary global controller 16 will now be described. The global controller 16 is configured to recall the first and second stage height information for one of the first or second cans and communicate with first and second drive mechanisms to change the first and second stage heights, H1, H2, respectively based on the first and second stage height information stored for the respective first or second can. The global controller 16 is configured to change the first and second stage heights using the first and second stage height information without subsequent manual manipulation of the first or second stage heights. The global controller 16 at a single location may adjust the height of the entire automated can height adjustment system 10, 10*a*, 10*b*. As will be described in connection to FIG. 14, the global controller 16 may be include a human machine interface ("HMI"). The general operation of this automated can height adjustment system 10, 10*a*, 10*b* enables the operator to program the global controller 16 with can height settings from each stage. For example, the operator may initially make adjustments to each of the hold down belt stage(s) 100.

FIG. 1B shows the hold down belt stage(s) 100 as including a drive mechanism 102, a height sensing device 104, and a local controller 106. Additionally, as shown, the belt stripper/blow-off stage(s) 200 includes a drive mechanism 202, a height sensing device 204, and a local controller 206. The blow-off nozzle stage(s) 300 includes a drive mechanism 302, a height sensing device 304, and a local controller 306. The vacuum or magnetic transfer stage(s) 400 includes a drive mechanism 402, a height sensing device 404, and a local controller 406. The jam detector stage(s) 500 includes a drive mechanism 502, a height sensing device 504, and a local controller 506. The dryer plenum stage 600 includes a drive mechanism 602, a height sensing device 604, and a local controller 606.

While FIGS. 1A and 1B show each stage as including an individual drive mechanism 102, 202, 302, 402, 502, 602 and an individual height sensing device 104, 204, 304, 404, 504, 604 (FIG. 1B further showing each stage as including an individual local controller), one or more of these components may be shared between multiple stages, if desired. As shown in FIG. 1B, the global controller 16 and the local controllers 106, 206, 306, 406, 506, 606 are in communication with their respective stage as will be described in greater detail below according to an exemplary embodiment.

For example, the automated can height adjustment system 10, 10*a*, 10*b* may include a local controller 106 configured to make micro-adjustments to a first stage height H1 in addition to the adjustments made by the global controller 16. Likewise, the local controller 206 may be configured to make micro-adjustments to a second stage height H2 in addition to the adjustments made by the global controller 16. Similarly, the local controller 306 may be configured to make micro-adjustments to a third stage height H3 in addition to the adjustments made by the global controller 16. Similarly, the local controller 406 may be configured to make micro-adjustments to a fourth stage height H4 in addition to the adjustments made by the global controller 16. Similarly, the local controller 506 may be configured to make micro-adjustments to a fifth stage height H5 in addition to the adjustments made by the global controller 16. Similarly, the local controller 606 may be configured to make micro-adjustments to a sixth stage height H6 in addition to the adjustments made by the global controller 16.

Figure 8:
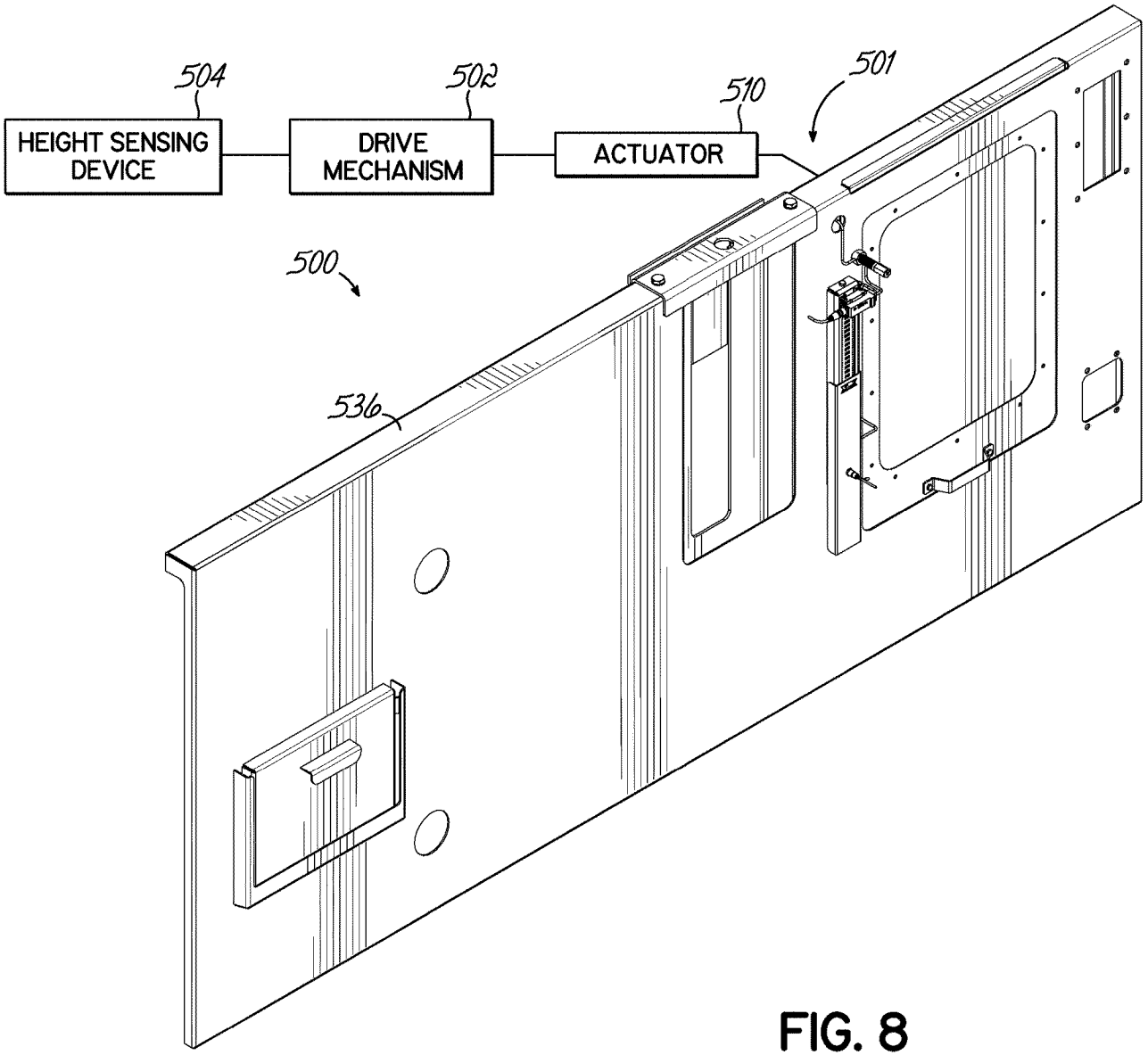
FIG. 8 shows a perspective view of the jam detector stage of FIG. 2 including a jam detector stage height adjustment system according to an exemplary embodiment.
Figure 8A:
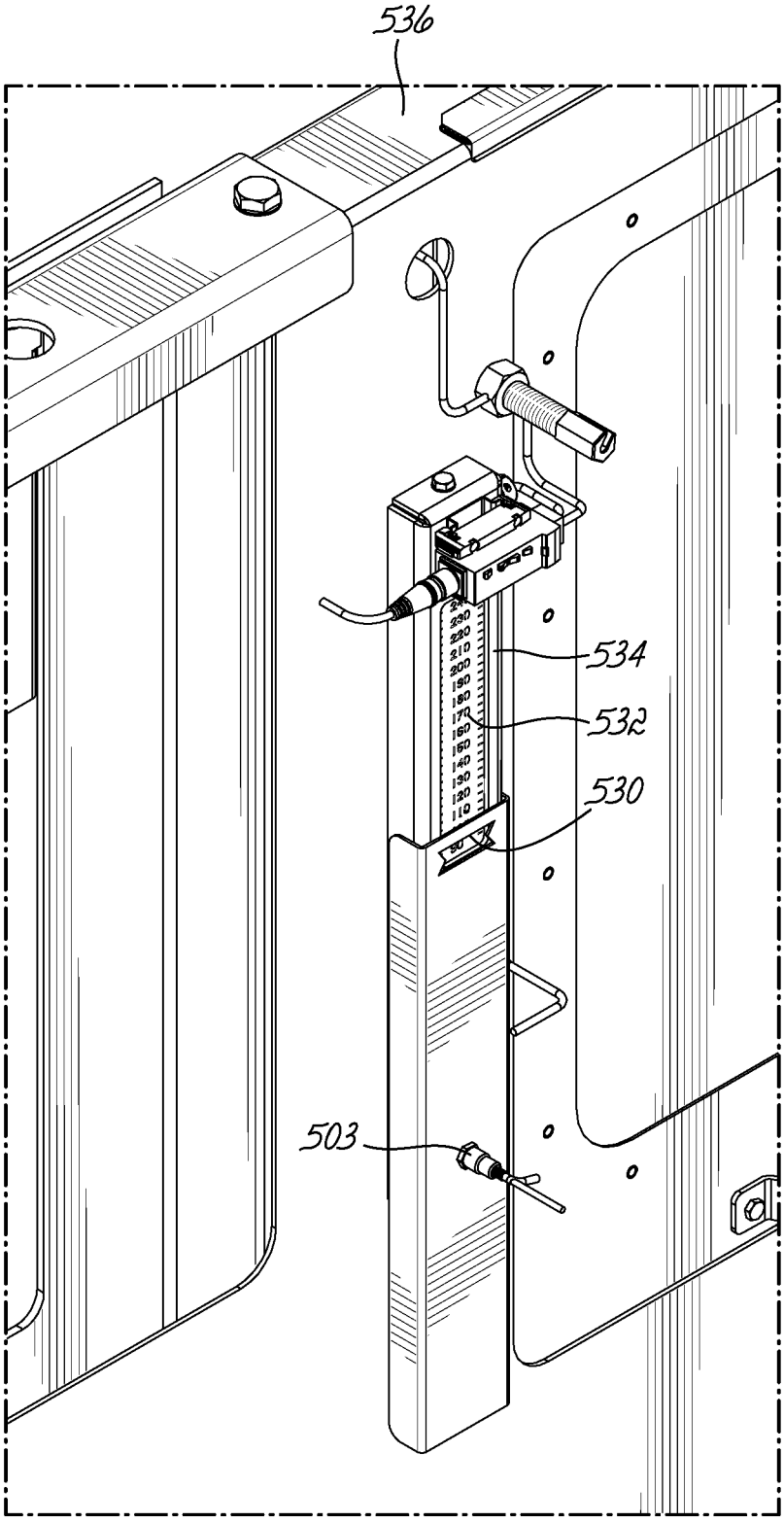
FIG. 8A shows a detailed perspective view of the jam detector stage height adjustment system of FIG. 8.

FIG. 2 shows an exemplary embodiment of the automated can height adjustment system 10*b* as including various stages: a first hold down belt stage 100*a*, a second hold down belt stage 100*b*, a first belt stripper/blow-off stage 200*a*, a first blow-off nozzle stage 300*a*, a second belt stripper/blow-off stage 200*b*, a third belt stripper/blow-off stage 200*c*, a second blow-off nozzle stage 300*b*, a third blow-off nozzle stage 300*c*, a fourth blow-off nozzle stage 300*d*, a fourth belt stripper/blow-off stage 200*d*, a transfer stage 400 (for example using a vacuum or magnetic force), and a dryer plenum stage 600. The jam detector stage(s) 500 shown in FIGS. 8 and 8A are not shown in FIG. 2, but are shown in FIGS. 1A and 1B.

Features of the individual stages will now be discussed in greater detail. For example, the first stage may be any stage of the can washer 12 (including stages 100, 200, 300, 400, 500, 600), and the second stage may be any subsequent stage (including stages 100*b*, 200*b*, 300*b*, 500*b*), of the can washer 12. Alternatively, the first stage may be any stage of the can washer 12 and the second stage may be any stage of the dry-off oven 14, such that the global controller 16 causes the respective drive mechanisms 102, 202, 302, 402, 502, 602 to adjust the first and second stage heights H1, H2, H3, H4, H5, H6 without a user (e.g. an operator) manually adjusting the can washer 12 and/or the dry-off oven 14.

Hold Down Belt Stage(s)

Figures 3, 3A, 3B, 3D:
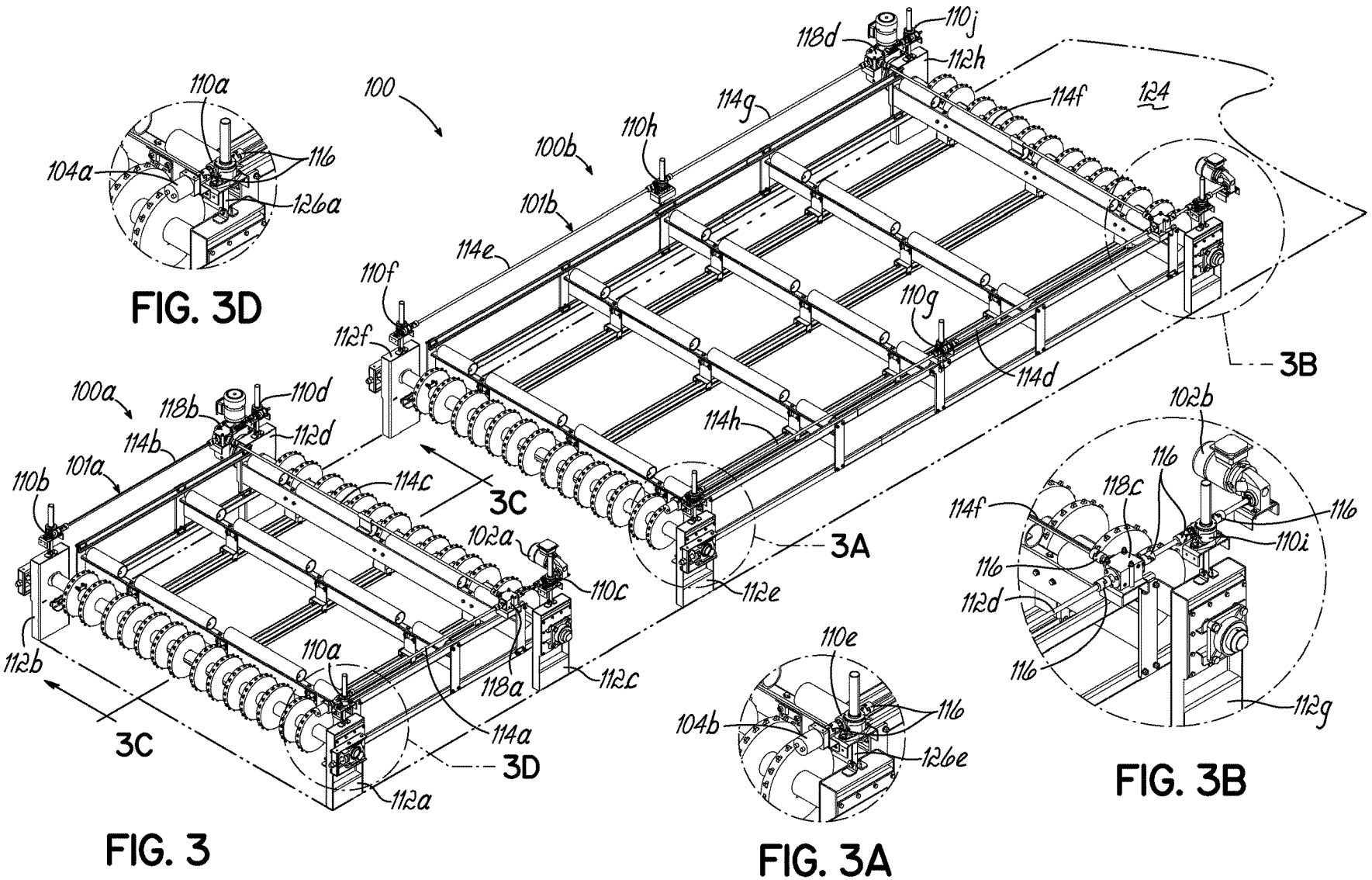
FIG. 3 shows a perspective view of the hold down belt stages of FIG. 2, including a hold down belt stage height adjustment system according to an exemplary embodiment.
FIG. 3A shows a detailed perspective view of the detailed portion 3A of FIG. 3.
FIG. 3B shows a detailed perspective view of the detailed portion 3B of FIG. 3.
FIG. 3D shows a detailed perspective view of the detailed portion 3A of FIG. 3.

FIG. 3 shows the hold down belt stage(s) 100 as including a first hold down belt stage 100*a* and a second hold down belt stage 100*b*. The automated can height adjustment system 10*b* (FIG. 2) includes a hold down belt height adjustment system 101*a-b*. The height sensing device 104 is configured to sense a first stage height H1 (shown in FIG. 3C) for each of the at least first and second cans. The height sensing device 104*a-b* is configured to generate first stage height information for the hold down belt stages 100*a-b* for each of the at least first and second cans.

As shown in FIG. 3, the height of a first hold down belt 108*a* (shown in FIG. 3C) is controlled with one or more actuators 110*a-d* operatively coupled to hold down bearing boxes 112*a-d*. The actuators 110*a-d* may also be operatively coupled to any part of the first hold down belt stage 100*a* that is stationary with respect to moving parts associated with operating the hold down belts 108*a*. The height of the second hold down belt (not shown) is controlled with one or more actuators 110*e-j* connected to hold down bearing boxes or frames 112*e-j*. Each actuator 110*a-h* is controlled by a drive mechanism 102*a-b* that operates to raise or lower the height of the actuator 110*a-j*. The drive mechanism 102*a-b* and the actuators 110*a-j* may be tied together through a combination of drive shafts 114*a-h* and couplings 116. According to an exemplary embodiment, one or more of the drive shafts 114*a-h* may be keyed. More specifically, the first drive mechanism 102*a* may be operatively coupled to drive shafts 114*a-c* that are operatively coupled to right angle gearboxes 118*a-b*. Similarly, the right angle gearboxes 118*a-b* are operatively coupled to actuators 110*a-d* through a set of couplings 116. The couplings 116 may include a spider coupling and a jaw coupling connected to one or more drive shafts 114*a-c* (which may or may not be keyed). The right angle gearboxes 118*a-b*, e.g. bevel gearboxes, may be used to change the direction of motion. The hold down belt 108*a* may be raised and lowered using only a single drive mechanism 102*a* linked to multiple actuators 110*a-d* according to an exemplary embodiment. The actuators 110*a-j* may be fastened to the first and second hold down belt stages 100*a-b* using brackets 120 and fasteners 122.

As shown in FIGS. 3 and 3B, the drive mechanisms 102*a-b*, shown as gearmotors, are configured to be operatively coupled with the first and second hold down belt stage 100*a-b* to adjust a first stage height H1 between accommodating the at least first and second cans having different can heights on a belt/conveyor 124. The speed of adjustment slows down as the first and second stage height for the first can is approached. The first drive mechanism 102*a* may include a drive motor and a power supply that controls the drive motor to operate the drive motor using at least first and second speeds. It may be beneficial that the first speed is greater than the second speed and is used initially, and the second speed is used when the first stage height H1 approaches its desired height position, such that the rate of change in height decreases. While belt/conveyor 124 is illustrated as a single continuous belt extending throughout the washer stage 12 (FIGS. 3, 4, and 5), the belt/conveyor 124 may be replaced with multiple, discontinuous belts to transfer cans through the individual stages of washer stage 12.

Figure 3C:
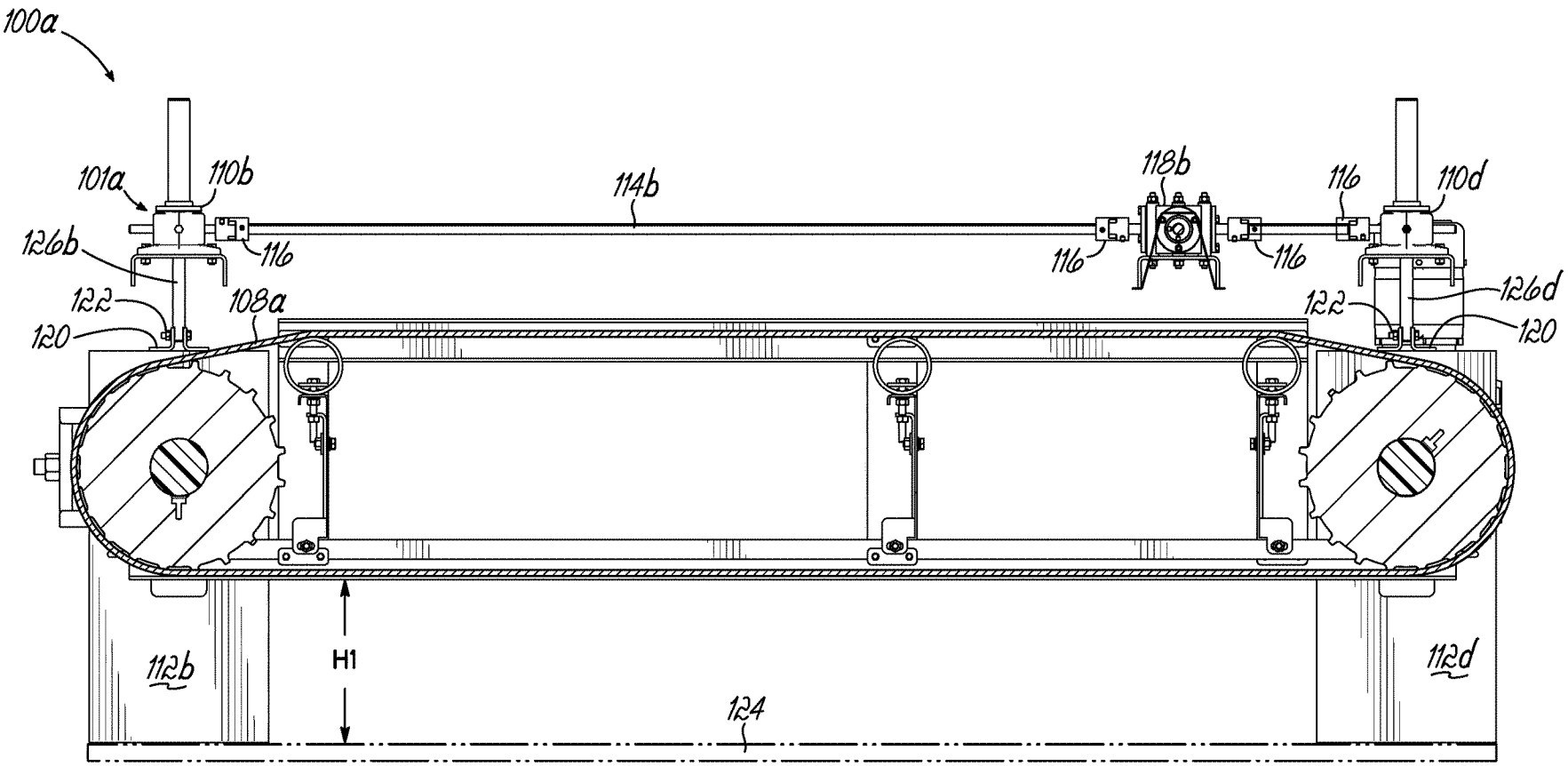
FIG. 3C shows a cross-sectional side view taken across line 3C-3C of FIG. 3.

As shown in FIGS. 3, 3A, 3B, and 3D, the height sensing devices 104*a-b* are operatively coupled to at least one actuator 110*a-i* to determine the position of the actuator rod 126*a-j*. The first height sensing device 104*a* may include a rotary encoder that is operatively coupled to an actuator 110*a-d* having an actuator rod 126*a-d*, and height sensing device 104*a-b* senses the height of the actuator rod 126*a*, 126*e* to determine the first stage height information. The height sensing devices 104*a-b*, are operatively coupled with the drive mechanisms 102*a-b*. The height sensing device 104*a-b* may be any device suitable to adjust the first stage height H1 (FIG. 3C). Suitable height sensing devices may include, but are not limited to, a linear variable differential transformer device "LVDT" (also known as a linear variable displacement transducer or a differential transformer), an optical measurement device (e.g. angular-based or time-based measurements), sonic or ultrasonic measurement device (e.g. angular-based, phase shift-based, or time-based measurements), a linear encoder device (e.g. absolute or relative/incremental), a rotary encoder (e.g. absolute or relative/incremental), a rheostat or potentiometer (e.g. rotary or linear), or any other suitable height sensing device.

The global controller 16 is in communication with the drive mechanisms 102*a-b* and the height sensing devices 104*a-b*. The global controller 16 is configured to receive and store (from the height sensing devices 104*a-b*), the first stage height information for the first hold down belt stage 100*a* for each of the at least first and second cans. The stage height information may be saved as part of the settings for a particular can size, such as in a preset in the global controller 16 as will be discussed with respect to FIGS. 10-13. The global controller 16 subsequently recalls the first stage height information for one of the at least first or second cans. The global controller 16 subsequently communicates with the drive mechanism 102*a* to adjust the first stage height H1 based on the first stage height information stored for the respective first or second can.

Figure 4:
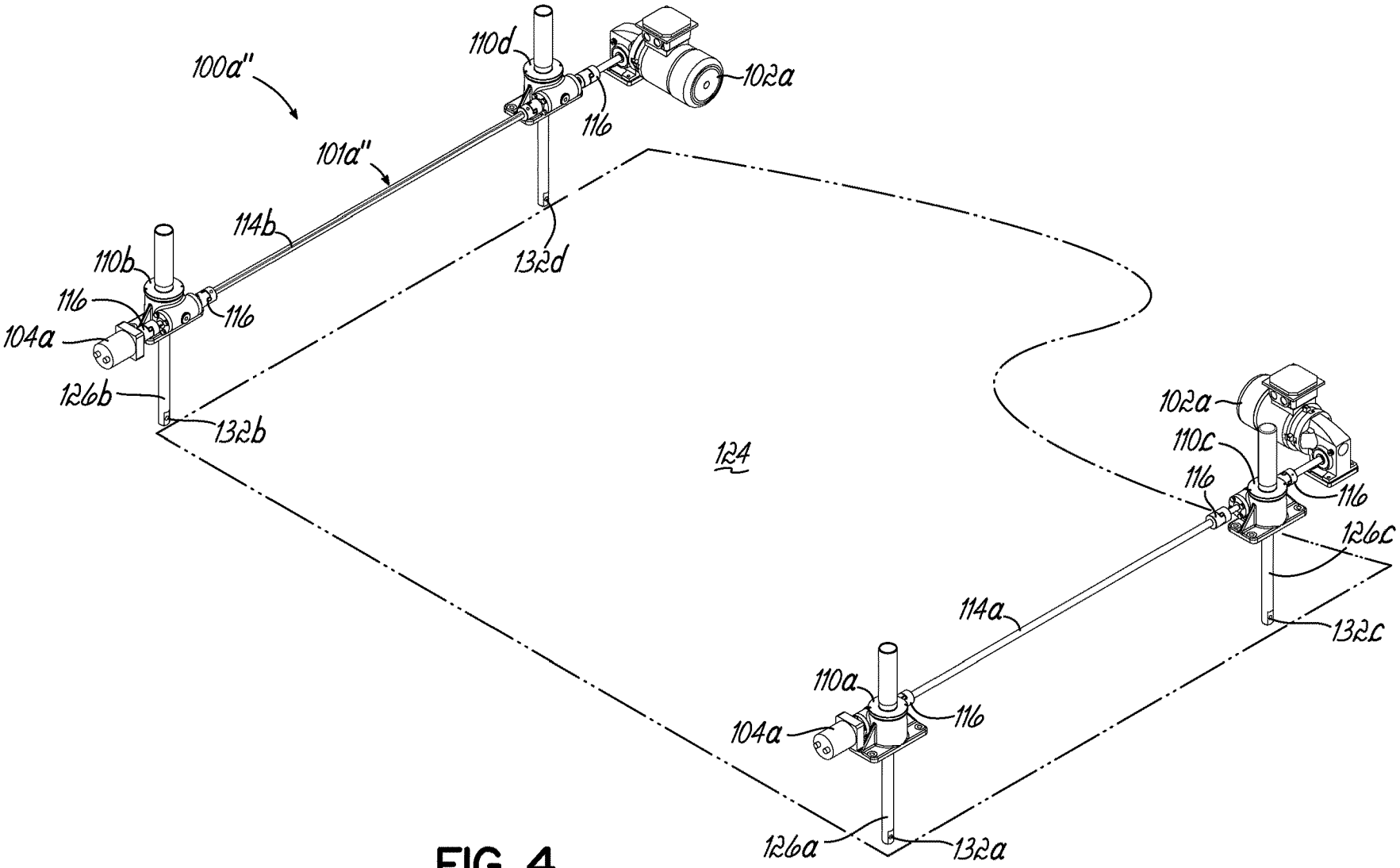
FIG. 4 shows a perspective view of an alternative embodiment of a hold down belt stage height adjustment system.
Figure 4A:
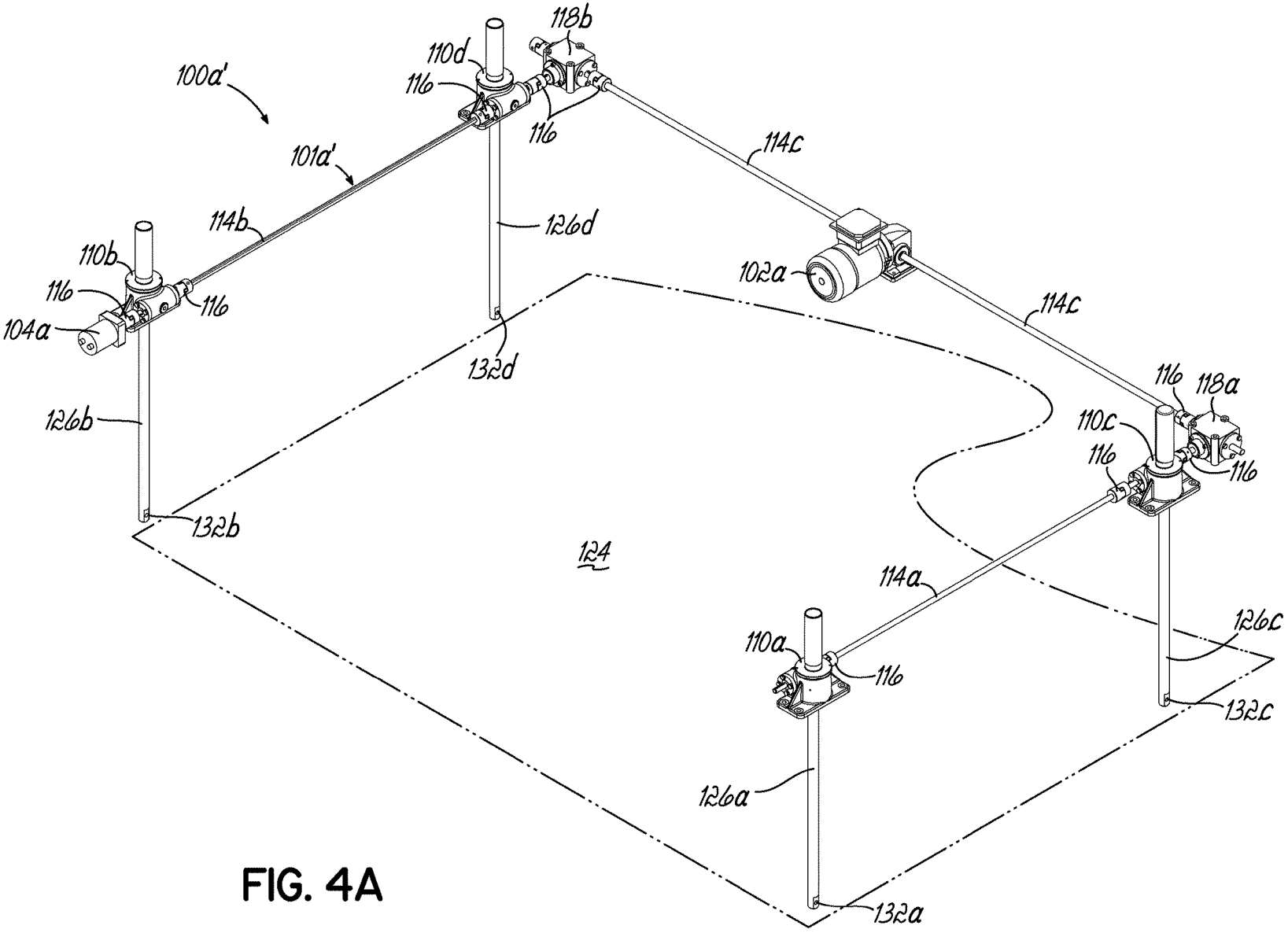
FIG. 4A shows a perspective view of another embodiment of a hold down belt stage height adjustment system.

FIGS. 4 and 4A show alternative embodiments of the first hold down belt stage height adjustment system 101*a*, with the first hold down belt stage 100*a* being removed, so that greater clarity can be provided for the first hold down belt stage height adjustment system 101*a*', 101*a*". The first hold down belt stage height adjustment systems 101*a*'-*a*" include many of the same elements as the previously described embodiment (first hold down belt stage height adjustment system 101*a*), and these elements have been provided with the same reference numbers where the elements are substantially similar or identical.

FIG. 4 shows two drive mechanisms 102*a* and two height sensing devices 104*a* being used in conjunction with the first hold down belt stage 100*a*", one for each side of the hold down belt stage. Alternatively, FIG. 4A shows only a single drive mechanism 102*a* being used in conjunction with the first hold down belt stage 100*a*'. As shown in FIGS. 4 and 4A, each actuator includes an actuator rod 126*a-d* that extends towards the belt/conveyor 124. In FIGS. 4 and 4A, the lower portion of the actuator rods 126*a-d* include apertures 132*a-d* configured to receive the fasteners 122 (FIG. 3C) that are coupled with the brackets 120 (FIG. 3C) to attach the first hold down belt stage height adjustment system 101*a*', 101*a*" to the first hold down belt stage 100*a*.

Exemplary components for use in the first hold down belt stage height adjustment systems 101*a-a*" are shown below in TABLE 1. This listing of components is not intended to be limiting.

TABLE 1

| Hold Down Belt Stage(s) - Exemplary Components |
|---|
| NORD Gearmotor (#SK1SMID31AX-63L4) |
| Lovejoy L070 Jaw Coupling |
| Lovejoy L070 Sox Solid Center Spider 10406-685144 |
| Duff Norton 1800 Series 1 Ton Inverted Actuator |
| Shaft with Keyway (Cut to Length) |
| Hubcity M2 Bevel Gearbox |
| AMCI Multi-turn Rotary Encoder (#NR25F-A5E2AE04) |

Belt Stripper/Blow-Off Stage(s)

Figure 5:
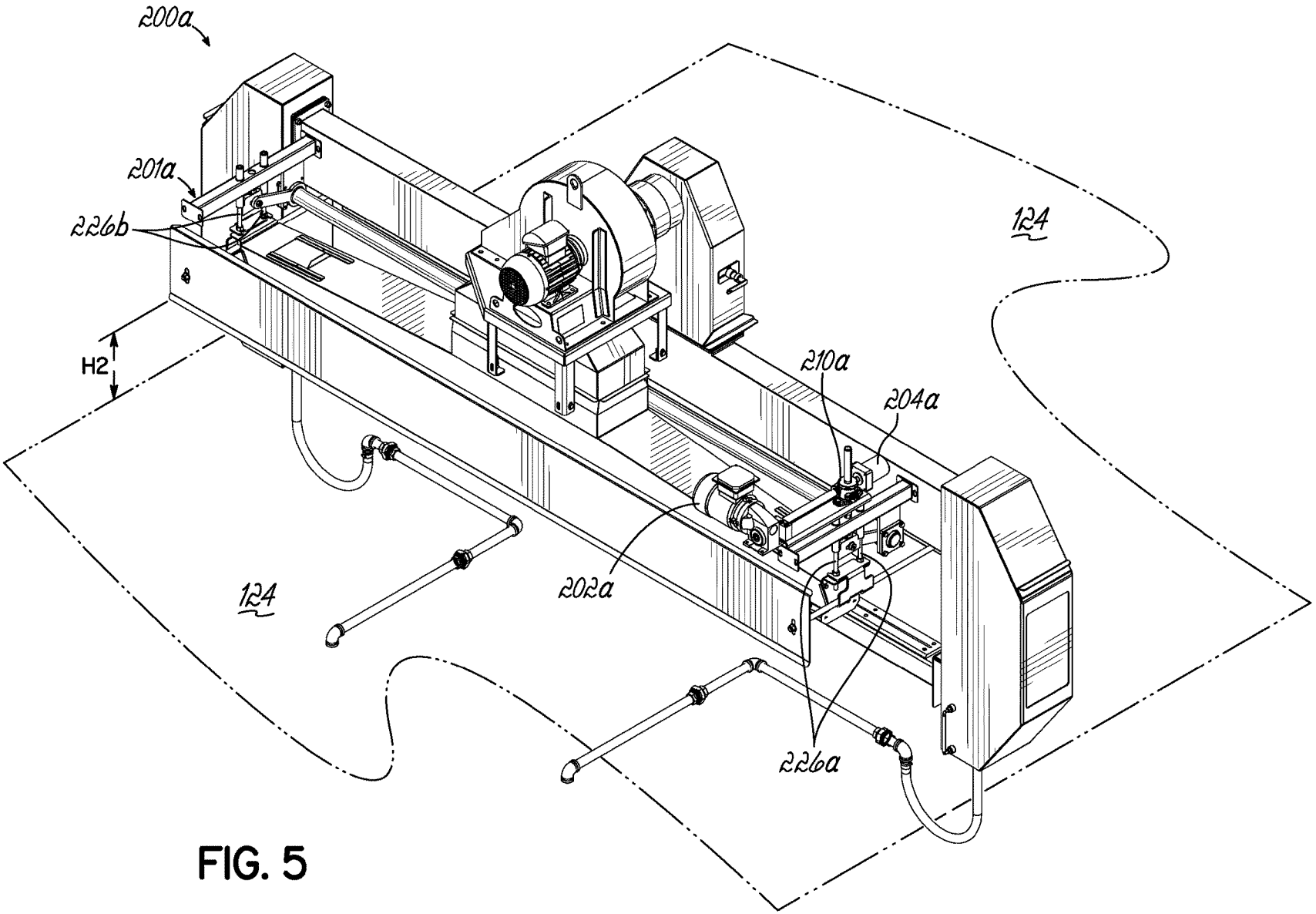
FIG. 5 shows a perspective view of a first belt stripper/blow-off stage of FIG. 2 including a first belt stripper/blow-off stage height adjustment system according to an exemplary embodiment.

FIG. 5 shows the first belt stripper/blow-off stage height adjustment system 201*a* of FIG. 2 according to an exemplary embodiment, where the first belt stripper/blow-off stage height adjustment system 201*a* is operatively coupled to the first belt stripper/blow-off stage 200*a*. The second, third and fourth belt stripper/blow-off stages 200*b-d* and corresponding belt stripper/blow-off stage height adjustment systems 201*b-d* have a similar structure, and further discussion is omitted for the sake of brevity. The first belt stripper/blow-off stage height adjustment system 201*a* includes many of the same elements as the previously described embodiment (hold down belt height adjustment system 101*a-b*), and these elements have been provided with similar reference numbers in the 200 series where the elements are substantially similar or identical. For example, the first belt stripper/blow-off stage height adjustment system 201*a* may include a drive mechanism 202*a*, a height sensing device 204*a*, actuator 210*a*, couplings (not shown), actuator rods 226*a-b*, and the belt/conveyor 124.

The drive mechanism 202*a* is configured to be operatively coupled with the belt stripper/blow-off stage 200*a-d* to enable the belt stripper/blow-off stages 200*a-d* to adjust a second stage height H2 between accommodating the at least first and second cans. The height sensing device 204*a* is operatively coupled with the drive mechanism 202*a*, and is configured to sense a second stage height H2 for each of the at least first and second cans. The second height sensing device 204*a* is configured to generate second stage height information for the belt stripper/blow-off stage 200*a* for each of the first and second cans. The global controller 16 is in communication with the first and second drive mechanisms 102*a-b*, 202*a* and the first and second height sensing devices 104*a-b*, 204*a*. The global controller 16 is configured to receive from the respective first and second height sensing devices 104*a-b*, 204*a*, and subsequently store, the first and second stage height information for each of the at least first and second cans for each of the stages 100*a-b*, 200*a-d*.

Blow-Off Nozzle Stage(s)

Figure 6:
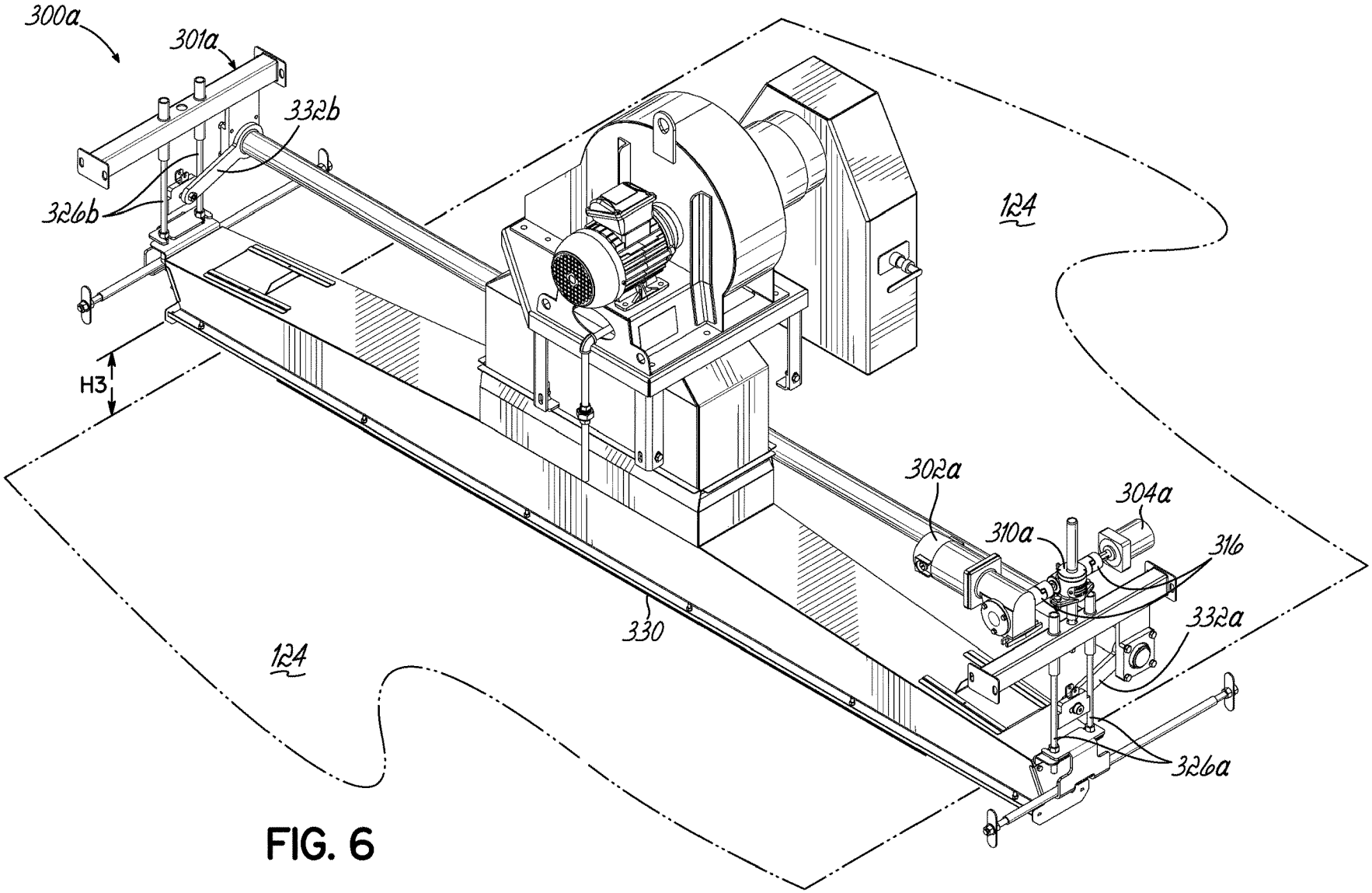
FIG. 6 shows a perspective view of a first blow-off nozzle stage of FIG. 2 including a blow-off nozzle stage height adjustment system according to an exemplary embodiment.

FIG. 6 shows a first blow-off nozzle stage height adjustment system 301*a* according to an exemplary embodiment that is operatively coupled to the first blow-off nozzle stage 300*a* according to an exemplary embodiment. The second, third and fourth blow-off nozzle stages 300*b-d* and corresponding second, third and fourth blow-off nozzle stage height adjustment systems 301*b-d* have a similar structure, and further discussion is omitted for the sake of brevity. The first blow-off nozzle stage height adjustment system 301*a* includes many of the same elements as the previously described embodiment (first belt stripper/blow-off stage height adjustment system 201*a*), and these elements have been provided with similar reference numbers in the 300 series where the elements are substantially similar or identical. For example, the first blow-off nozzle stage height adjustment system 301*a* may include a drive mechanism 302*a*, a height sensing device 304*a*, actuator 310*a*, couplings 316, and the belt/conveyor 124.

FIG. 6 shows the general layout of the first blow-off nozzle stage height adjustment system 301*a*. The height of the blow-off nozzle 330 is controlled with the actuator 310*a* located above and coupled to the blow-off nozzle 330 through a control arm 332*a-b*. As the actuator 310*a* is operated, the control arm 332*a-b* raises and lowers the blow-off nozzle 330. The drive mechanism 302*a* is coupled to one end of the actuator 310*a* and extends the actuator rods 326*a-b* up and down, and therefore, the position of the control arm and the blow-off nozzle 330 up and down. A height sensing device 304*a* is connected to the actuator 310*a* to determine the position of the actuator rod 326*a-b*. The height sensing device 304*a* is in communication with the global controller 16, so that the height information can be saved as part of the settings for a particular can size.

Exemplary components for use in the first blow-off nozzle stage height adjustment system 301*a* are shown below in TABLE 2. This listing of components is not intended to be limiting.

TABLE 2

| Blow-off Nozzle Stage(s) Exemplary Components |
|---|
| NORD Gearmotor (#SK1SMID31AX-63L4) |
| Lovejoy L070 Jaw Coupling |
| Lovejoy L070 Sox Solid Center Spider (10406-685144) |
| Duff Norton 500 lb Actuator (A1ASBCPNXA-4-2-A1XXA1X) |
| Shaft with Keyway (Cut to Length) |
| AMCI, Multi-turn Rotary Encoder(#NR25F-A5E2AE04) |

Transfer Stage(s)

Figures 7, 7A, 7B, 7C:
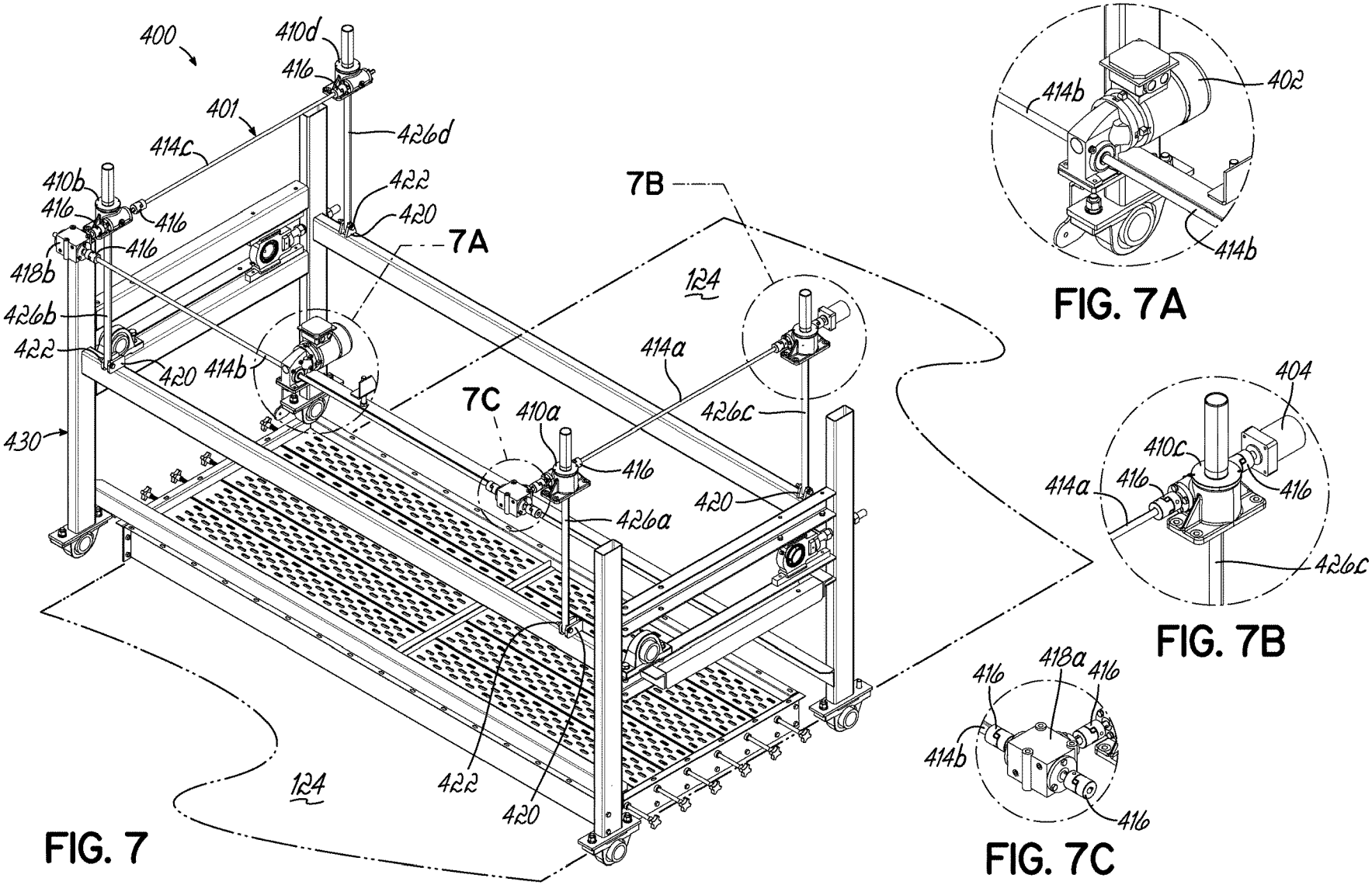
FIG. 7 shows a perspective view of a vacuum transfer stage of FIG. 2 including a vacuum transfer stage height adjustment system according to an exemplary embodiment.
FIG. 7A shows a detailed perspective view of the detailed portion 7A of FIG. 7.
FIG. 7B shows a detailed perspective view of the detailed portion 7B of FIG. 7.
FIG. 7C shows a detailed perspective view of the detailed portion 7C of FIG. 7.

FIG. 7 shows a transfer stage height adjustment system 401 according to an exemplary embodiment that is operatively coupled to the transfer stage 400. The transfer stage height adjustment system 401 includes many of the same elements as the previously described embodiment (first blow-off nozzle height adjustment system 301*a*), and these elements have been provided with similar reference numbers in the 400 series where the elements are substantially similar or identical. For example, the transfer stage height adjustment system 401 may include a drive mechanism 402, a height sensing device 404, actuators 410*a-d*, drive shafts 414*a-c*, couplings 416, right angle gearboxes 418*a-b*, brackets 420, fasteners 422, the belt/conveyor 124, and actuator rods 426*a-d*.

Figure 7D:
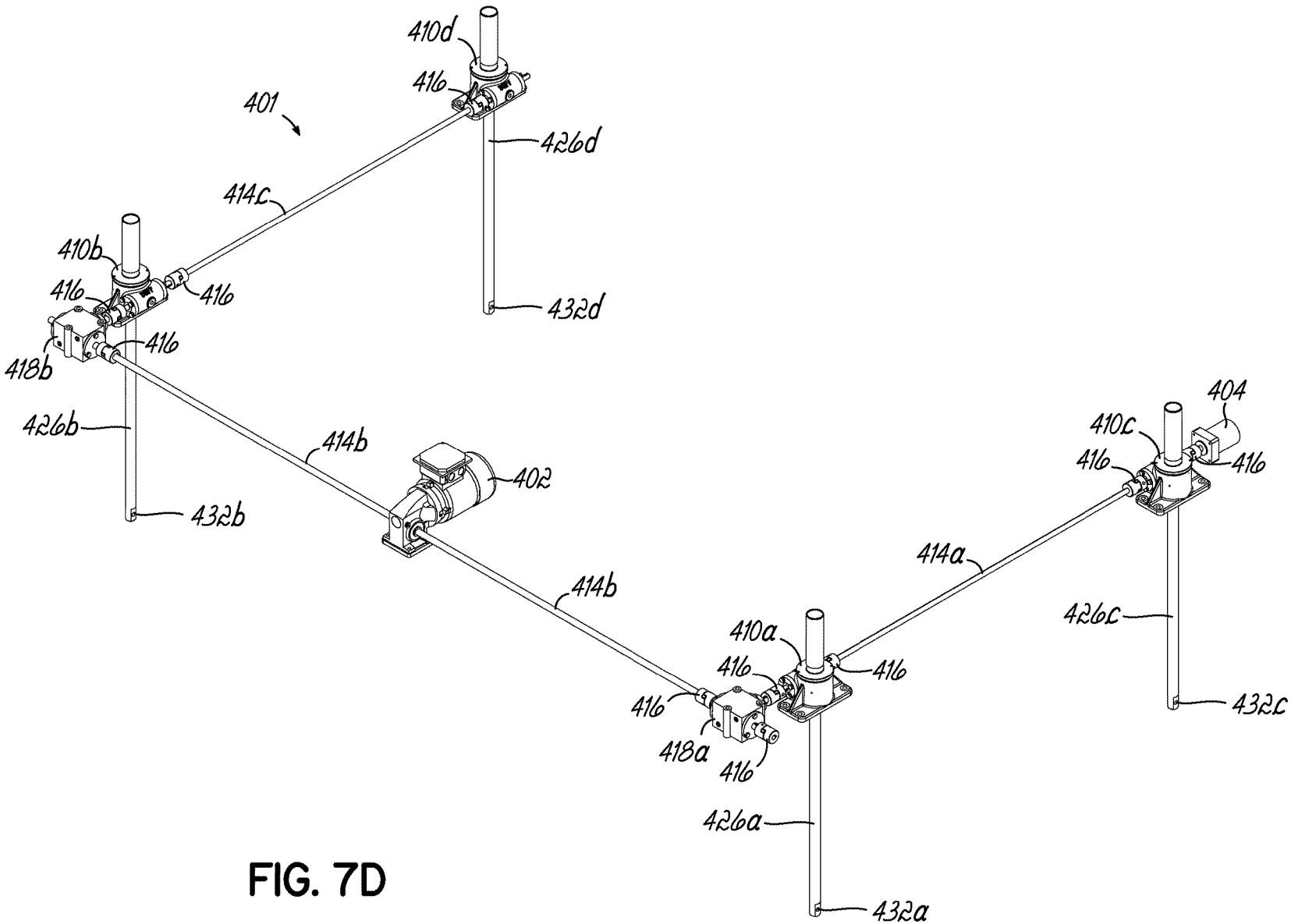
FIG. 7D shows a perspective view of the vacuum transfer stage height adjustment system of FIG. 7 removed from the rest of the vacuum transfer stage.

FIG. 7D shows the general layout of an exemplary transfer stage height adjustment system 401 removed from the rest of the transfer stage 400. As shown, the transfer stage height adjustment system 401 uses actuators 410*a-d* located on top of a transfer box assembly 430 (FIG. 7). While the transfer stage generally uses vacuum or magnetic force to transfer the cans, other forces may also be used to transfer the cans. As shown, the actuators 410*a-d* are controlled by a drive mechanism 402 that rotates the actuators 410*a-d* to extend the actuator rods 426*a-d* up and down. The drive mechanism 402 is coupled to a drive shaft 414*a-c* (which may be keyed) that is coupled to right angle gearboxes 418*a-b* (e.g. bevel gearboxes). The right angle gearboxes 418*a-b* are coupled to the actuators 410*a-d* through a set of couplings 416 and drive shafts 414*a-c*. A height sensing device 404 is operatively coupled to at least one actuator (shown as actuator 410*c*) to determine the position of the actuator rod (shown as actuator rod 426*c*). However, the height sensing device 404 may be operatively coupled to any of the actuators 410*a-d* as desired. The height sensing device 404 is in communication to the global controller 16 (shown in FIGS. 1A and 1B), so that the height information may be saved as part of the settings for a particular can size. As shown in FIG. 7D, the lower portion of the actuator rods 426*a-d* include apertures 432*a-d* configured to receive the fasteners 422 that are coupled with the brackets 420 to attach the transfer stage height adjustment system 401 to the transfer stage 400.

Exemplary components for use in the transfer stage height adjustment system 401 are shown below in TABLE 3. This listing of components is not intended to be limiting.

TABLE 3

| Vacuum Transfer Stage(s) Exemplary Components |
|---|
| NORD Gearmotor (#SK1SMID31AX-63L4) |
| Lovejoy L070 Jaw Coupling |
| Lovejoy L070 Sox Solid Center Spider (10406-685144) |
| Duff Norton 1801 Series 2 Ton Inverted Actuator |
| Shaft with Keyway (Cut to Length) |
| Hubcity M2 Bevel Gearbox |
| AMCI Multi-turn Rotary Encoder (#NR25F-A5E2AE04) |

Jam Detection Stage(s)

FIGS. 8 and 8A shows a jam detection stage height adjustment system 501 according to an exemplary embodiment that is operatively coupled to the jam detection stage 500. The jam detection stage height adjustment system 501 associated with the can washer 12 uses a height sensing device 504 that includes one or more sensors 503 to recognize if the processed cans are jammed. The height sensing device 504 used in the jam detection stage height adjustment system 501 are matched to the height of the can through the use of one or more actuators 510. The height sensing device 504 is operatively coupled to a drive mechanism 502 which is operatively coupled to the actuator 510 to determine the position of the actuator rod (not shown). A height gauge 530 can be read using heights 532 affixed to a measurement device 534 that is operatively coupled to the can washer housing 536. The height sensing device 504 is in communication with the global controller 16, so that the stage height information may be saved as part of the settings for a particular can size in a preset of the global controller 16. In the event that a height sensing device 504 detects a can that is not in correct orientation, a signal will be sent to the global controller 16 that will stop the belt/conveyor 124 (FIGS. 3-7) and sound a visual and/or audible alarm (not shown) notifying the operator of an error in the jam detection stage height adjustment system 501.

Dryer Plenum Stage(s)

Figures 9, 9A, 9B, 9C:
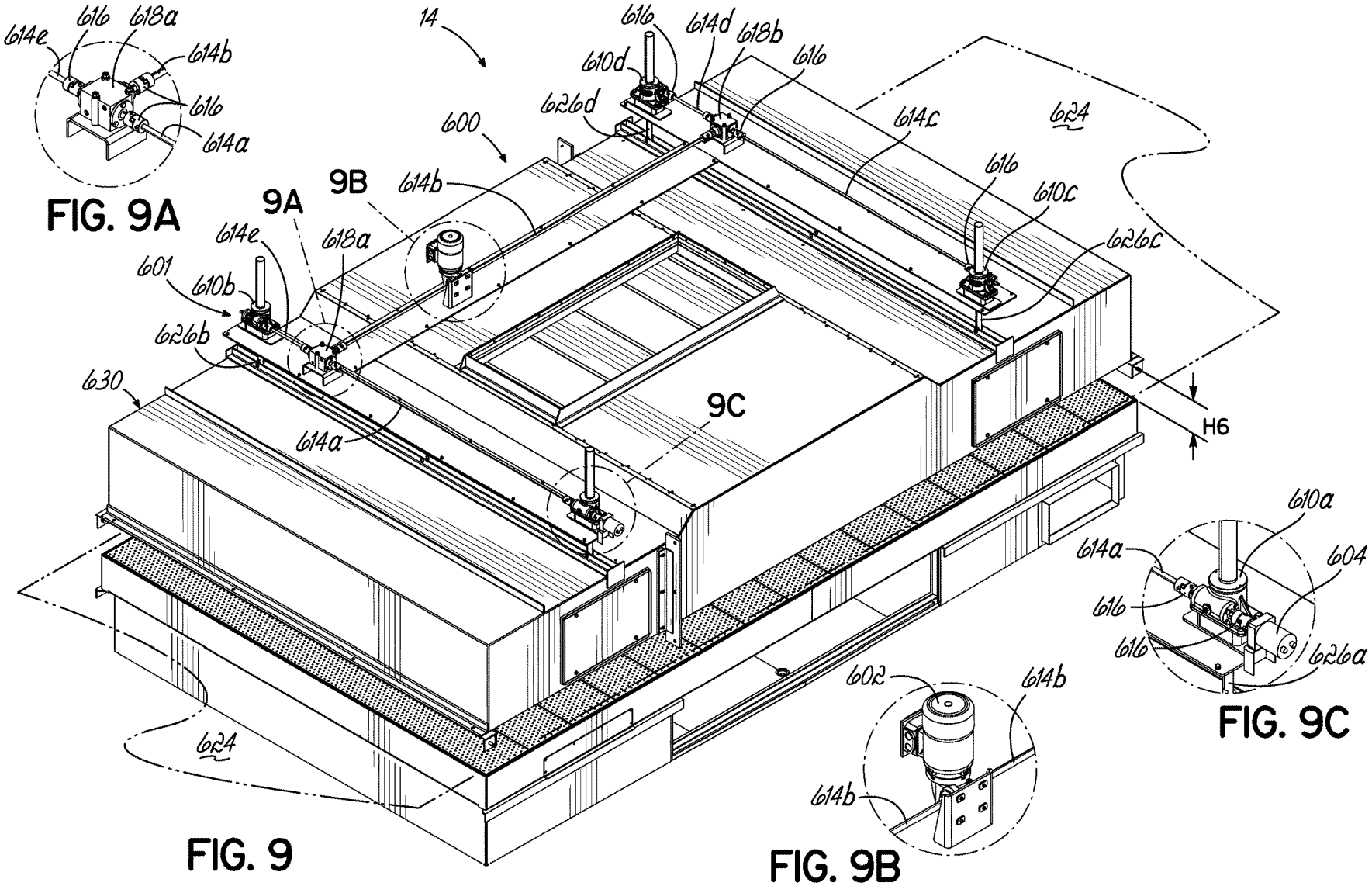
FIG. 9 shows the dryer plenum stage of FIG. 2 including a dryer plenum stage height adjustment system according to an exemplary embodiment.
FIG. 9A shows a detailed perspective view of the detailed portion 9A of FIG. 9.
FIG. 9B shows a detailed perspective view of the detailed portion 9B of FIG. 9.
FIG. 9C shows a detailed perspective view of the detailed portion 9C of FIG. 9.

FIG. 9 shows a dryer plenum stage height adjustment system 601 according to an exemplary embodiment that is operatively coupled to the dryer plenum stage 600 of the dry-off oven 14. The dryer plenum stage height adjustment system 601 includes many of the same elements as the previously described embodiment (transfer stage height adjustment system 401 (FIG. 7)), and these elements have been provided with similar reference numbers in the 600 series where the elements are substantially similar or identical. For example, the dryer plenum height adjustment system 601 may include a drive mechanism 602, a height sensing device 604, actuators 610*a-d*, drive shafts 614*a-e*, couplings 616, right angle gearboxes 618*a-b*, brackets (not shown), fasteners (not shown), the belt/conveyor 124, and actuator rods 626*a-d*.

FIG. 9 shows the general layout of an exemplary dryer plenum stage height adjustment system 601. The dryer plenum stage height adjustment system 601 uses actuators 610*a-d* coupled to the plenum box 630. The actuators 610*a-d* may be controlled by a single drive mechanism 602 that rotates the actuators 610*a-d* to extend the respective actuator rods 626*a-d* up and down. The drive mechanism 602 is operatively coupled with a drive shaft 614*b* that is coupled to right angle gearboxes 618*a-b*. The right angle gearboxes 618*a-b* are coupled to the actuators 610*a-d* through a set of couplings 616 and drive shafts 614*a*, 614*c-e*. A height sensing device 604 is operatively coupled with the actuators 610*a-d* to determine the height of the actuator rods 626*a-d*. The height sensing device 604 is in communication with the global controller 16, so that the dryer plenum stage height information may be saved as part of the settings for a particular can size in a preset of the global controller 16.

Exemplary components for use in the dryer plenum stage height adjustment system 601 are shown below in TABLE 4. This listing of components is not intended to be limiting.

TABLE 4

| Dryer Plenum Stage(s) Exemplary Components |
|---|
| NORD Gearmotor (#SK1SMID31AX-63L4) |
| Lovejoy L070 Jaw Coupling |
| Lovejoy L070 Sox Solid Center Spider (10406-685144) |
| Duff Norton 1801 Series 2 Ton Inverted Actuator |
| Shaft with Keyway (Cut to Length) |
| Hubcity M2 - Bevel Gearbox |
| AMCI Multi-turn Rotary Encoder (#NR25F-A5E2AE04) |

The hold down belt stage(s) 100, a belt stripper/blow-off stage(s) 200, a blow-off nozzle stage(s) 300, a vacuum or magnetic transfer stage(s) 400, jam detector stage(s) 500, and dryer plenum stage 600 may be equipped with similar or essentially identical automated adjustment systems, if desired. Electrical controls may include: (1) drive mechanism, which vertically move the components to accommodate a given can height; (2) a power supply that controls the drive motor at different speeds (e.g. a variable frequency drive controlling motor); (3) a height sensing device, which preserves actuator position information and sends it to the global controller 16; and (4) an HMI manual control pushbutton station with UP and DOWN jog pushbuttons, which may be used during maintenance or repair.

Presets may be controlled to account for various can sizes. As a result, adjustments can be done without a user, such as an operator, physically putting their hands on the machine. As such, the automated can height adjustment system 10, 10*a*, 10*b* allows adjustments to be made individually (e.g. locally) and/or collectively (e.g. globally). The global controller 16 includes a first preset for the first can that adjusts each of the at least first and second stage heights H1, H2. The global controller 16 includes a second preset for the second can that adjusts the at least first and second stage heights. The first preset may also adjust at least one fan speed, a blower speed, and a temperature setting. The height information from the at least first and second stages 100, 200 may be saved in a single preset in the global controller 16. Preset functionality for both individual stages 100, 200, 300, 400, 500, 600 and the entire can height adjustment system 10, 10*a*, 10*b* (e.g. preset to activate prior hold down position setting only or prior hold down setting in conjunction with the other settings of the rest of the system). It may be directable to include ancillary equipment settings as part of the broader "preset" definition. As a result, separate presets may be used for the same can height, but having different can widths or cans using different processing temperatures etc.

An exemplary and non-exhaustive list of potential process variables to include with can height presets include: (1) blow-off fan(s) speed and/or damper position(s), (2) washer vent fan(s) speed and/or damper position(s), (3) pump(s) setting, such as speed, pressure, or flow rate, for example, (4) spray pressure(s), (5) process temperature(s) (applicable to heated stages), (7) vacuum transfer suction pressure(s) and/or air flow rate(s), (8) dryer zone(s) temperature(s), (9) dryer recirculation fan(s) setting, such as speed, pressure, or flow rate, for example, (10) dryer exhaust fan(s) setting, such as speed, pressure, or flow rate, for example, (11) backflow setting(s), such as enable/disable or flow rate/range, for example, (12) variable process control setting(s), such as range(s) or set point(s), and/or (13) any other suitable process parameter.

Figure 10:
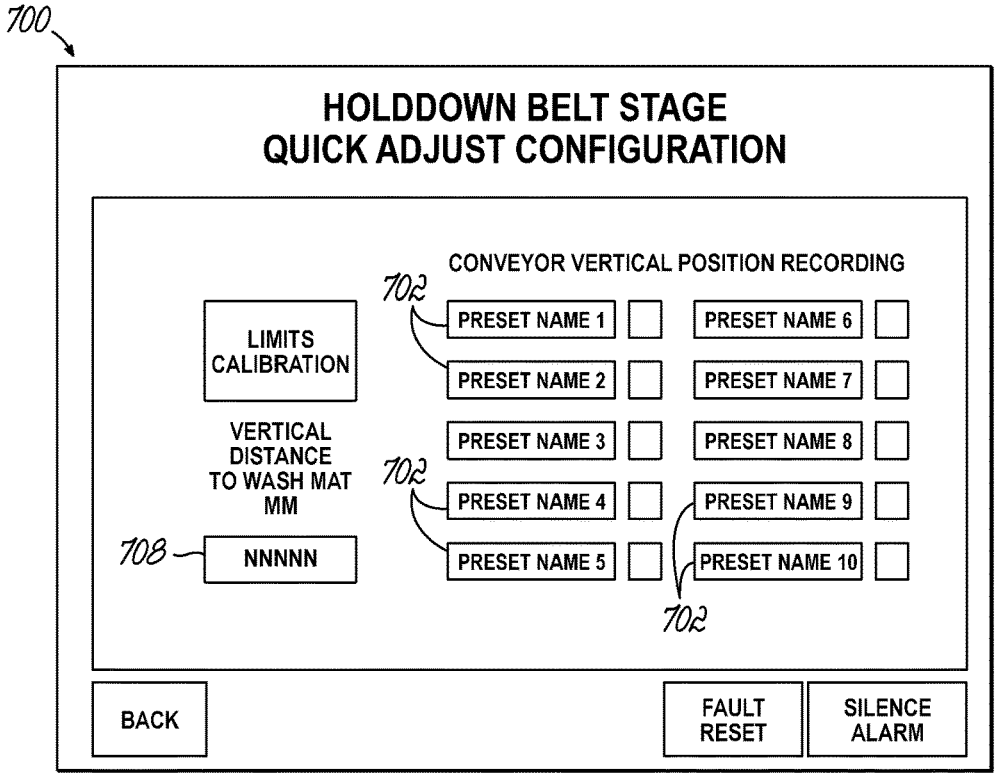
FIG. 10 is a schematic representation of a screen shot from the Holddown Belt Stage Quick Adjust Configuration screen according to an exemplary embodiment.
Figure 11:
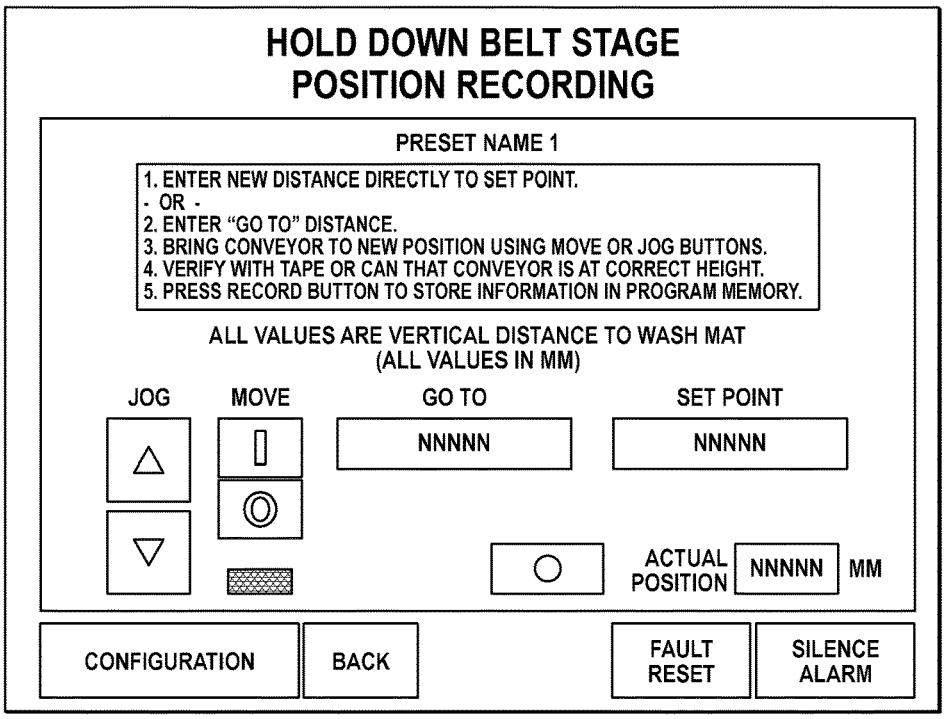
FIG. 11 is a schematic representation of a screen shot from the Hold Down Belt Stage Position Recording screen according to an exemplary embodiment.

An exemplary method of adjusting will now be described with respect to the first hold down belt stage 100*a*. The method of adjusting will apply to any of the other stages 100, 200, 300, 400, 500, 600 described herein. All indications of "NNNNN" in the FIGS. 10-13 refer to a numeric value. Once the desired height is achieved, the operator records the setting in the global controller 16 which includes a human machine interface (HMI) according to an exemplary embodiment. As shown in FIG. 10, the operator may adjust the first hold down belt stage 100*a* using the global controller 16, in the HOLD DOWN BELT STAGE QUICK ADJUST CONFIGURATION screen 700. Ten different preset buttons 702 are displayed on the screen 700. In the illustrated embodiment, up to ten different stage heights corresponding to ten different can heights may be stored, one stage height corresponding to one can height in each of the different preset buttons 702. For example, the first of the preset buttons 702 "PRESET NAME 1" is used to store a preset stage height corresponding to a first can height and the second of the preset buttons 702 "PRESET NAME 2" is used to store a preset stage height corresponding to a second can height, and so on. While ten preset buttons 702 are illustrated for this embodiment, fewer than ten preset buttons or more than ten preset buttons may be displayed or programmed. By selecting a preset button 702, the HMI will display FIG. 11. Next, the operator may move the first hold down belt stage 100*a* of the machine and adjusts the height of the hold down belt 108*a* to generally correspond to the height of the can. As shown in FIG. 11, the operator saves the recorded setting under the HMI blow-off quick adjust position recording screen under the preset name, e.g., PRESET NAME 1. The operator will perform similar adjustment steps for the other stages 100, 200, 300, 400, 500, 600. The operator will save the setting for each stage under the preset name, e.g., PRESET NAME 1. Each saved setting for each stage will be collectively saved under the preset name in the global controller, e.g. the HMI, can height changeover screen (FIG. 13).

Figure 13:
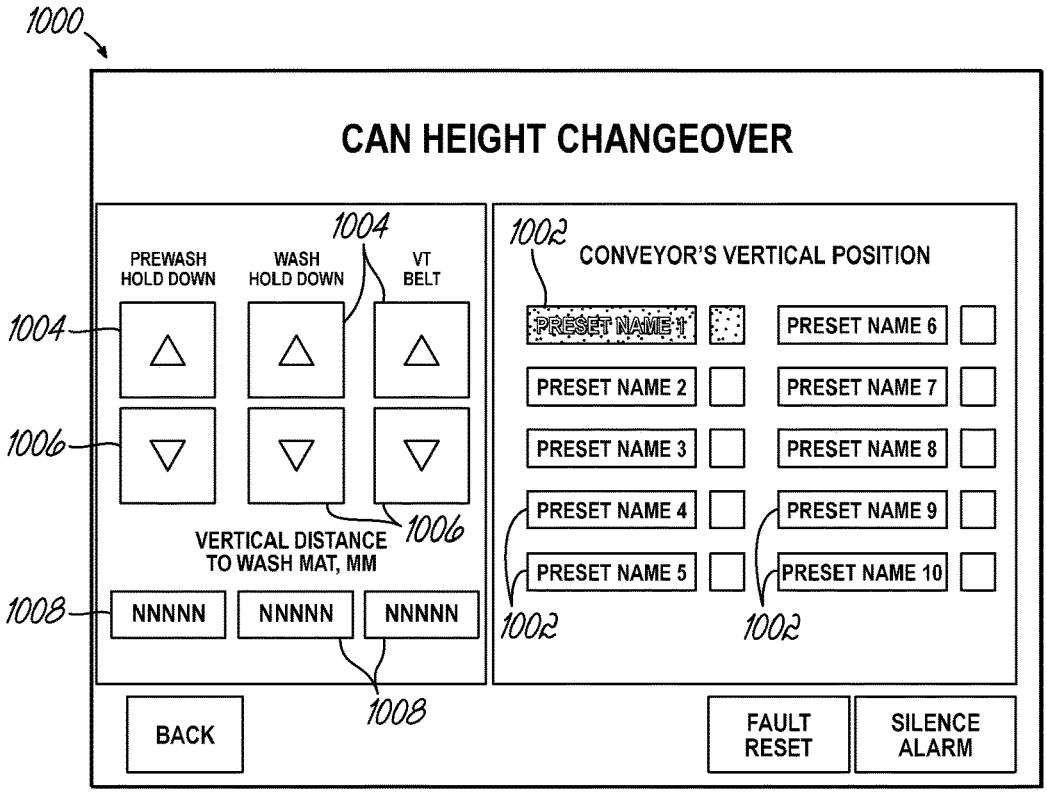
FIG. 13 is a schematic representation of a screen shot from a can height changeover screen according to an exemplary embodiment.

When it is time to run a can of a different size through the can cleaning system, the operator selects one of the preset buttons 1002, e.g., PRESET NAME 2, under the CAN HEIGHT CHANGEOVER screen of FIG. 13 corresponding to the different (second) can size and all stages move to the desired set height for that particular can. In other words, pushing a single preset button 1002 will change the height of each stage in the washer 12 and dryer 14 to correspond to a can height stored under a particular preset. To return to running the first can with its different height, the operator would reset the height throughout the can cleaning system by selecting the preset button 1002 for PRESET NAME 1.

Figure 12:
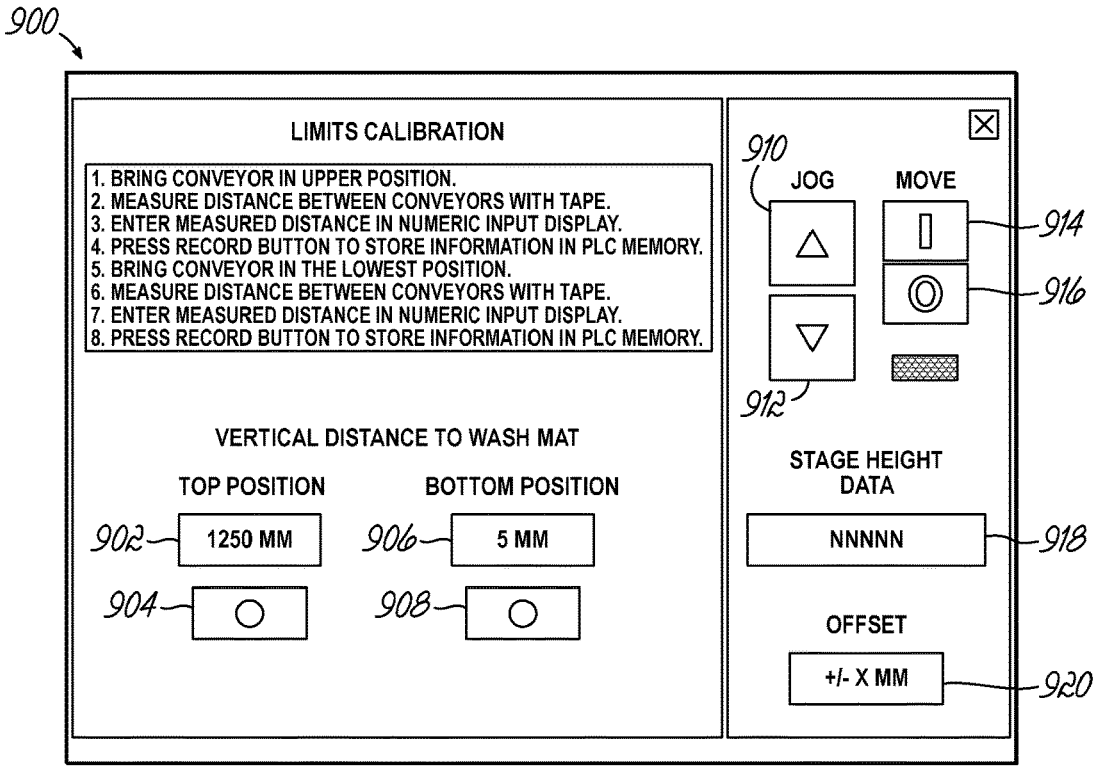
FIG. 12 is a schematic representation of a screen shot from a calibration screen according to an exemplary embodiment.

An exemplary method of calibration is now described with reference to FIG. 12. Control of the automated can height adjustment system 10, 10*a*, 10*b* is performed by the global controller 16. The operator controls the automated can height adjustment system 10, 10*a*, 10*b* from a user interface of the global controller 16. After the automated can height adjustment system 10, 10*a*, 10*b* is initially installed on the can cleaning system, each stage may be brought to its highest vertical position, shown as the TOP POSITION height 902 in FIG. 12, which may be considered the "zero point" for each respective stage 100, 200, 300, 400, 500, 600 as detected by each individual height sensing device 104, 204, 304, 404, 504, 604 which may use an absolute height position. The operator then presses a button 904 at the global controller 16 configuration screen to save the zero-point information from each height sensing device 104, 204, 304, 404, 504, 604 into the memory of the global controller 16. In a similar manner, each stage 100, 200, 300, 400, 500, 600 is brought to its lowest vertical position, shown as BOTTOM POSITION height 906 in FIG. 12, to define the lower limit of travel. The operator then presses a button 908 to store that lowest vertical height information in the global controller 16. After obtaining the upper and lower limits of the machine, the actuators of the respective stages 100, 200, 300, 400, 500, 600 are controlled to move the stages 100, 200, 300, 400, 500, 600 to correspond to a particular can size. Additionally, the operator may press the JOG up button 910 or the JOG down button 912 to move the stage height up or down as desired. The MOVE buttons 914, 916 are intended to allow or prevent the stage height from being changed. The screen 900 also displays the STAGE HEIGHT DATA 918 with an optional offset 920 being defined as well. For example, all the known can sizes may be entered before operation of a single can size, or can sizes, may be entered once desired to be used at a subsequent time. An alternative exemplary method of calibration may use a single point with a fixed vertical position relative to the belt/conveyor or another known reference point.

The individual stages 100, 200, 300, 400, 500, 600 may be moved up and down using the manual controls or pushbuttons on the global controller 16 configuration screen. The operator also has point-of-adjustment capability at each particular stage 100, 200, 300, 400, 500, 600 as shown in FIG. 1B using the respective local controllers 106, 206, 306, 406, 506, 606. This enables the operator to make adjustments at the stages 100, 200, 300, 400, 500, 600 with a machine side controller, while recording adjustments into the global controller 16 (e.g. the PLC memory). All heights corresponding to various can heights are retained in the global controller (e.g. the PLC memory) as a can height pre-set. Micro adjustments made on a local (affecting only one or a few components) or global (affecting all components) may be applied to each stage pre-set for the same size can. This allows the automated can height adjustment system 10, 10*a*, 10*b* to account for belt wear or other fine tuning requirements (e.g. the conveyor bed being releveled). For example, a belt/conveyor riding on a belt support (i.e. a conveyor bed) may gradually wear out, resulting in the belt getting thinner and thinner. As a result, this height variance may be accounted for by a micro adjustment, as desired.

Can washer changeover may be controlled via the CAN HEIGHT CHANGEOVER screen 1000 as shown in FIG. 13. The operator chooses the desired can height and selects a corresponding preset button 1002 on the CAN HEIGHT CHANGEOVER screen of the global controller 16. The preset button 1002 may appear darker as a result of the selection. This action activates the respective drive mechanisms 102, 202, 302, 402, 502, 602 (shown in FIGS. 1A and 1B) and the conveyor structure will move to the preset vertical position corresponding to the particular can size associated with that specific preset button 1002. When the desired height is reached, the corresponding preset button 1002 may change color to indicate the system is at the proper can height, e.g. the preset button 1002 may switch from red to green. The Manual UP jog buttons 1004 and/or the manual DOWN jog buttons 1006 may be removed from this screen if manual operation is not desired. The numerical display will display vertical distance 1008 to the conveyor belt. It may be desirable to include rapid traverse speeds shifting to a fraction of the traverse speed as final position is nearing. While the CAN HEIGHT CHANGEOVER screen in FIG. 13 illustrates only three stages (e.g., PRE-WASH HOLD DOWN, WASH HOLD DOWN, AND VT BELT), the CAN HEIGHT CHANGEOVER screen could also display all of the automated stages of the automated can height adjustment system 10, 10*a*, 10*b*.

Lock out control capability may also be incorporated according to an exemplary embodiment. For example, one or more levels of control may be provided for daily operators, maintenance individuals, and programmers. For example, daily operators may have basic control. Maintenance individuals may have the functionality of daily operators plus the ability to change between presets etc. Programmers may have the highest level of control, which would include the functionality of maintenance individuals plus have the ability to modify the presets.

TABLE 5 provides an exemplary, non-limiting, listing of suitable can sizes. TABLE 5 is not intended to be exhaustive, such that many other can sizes may also be suitable with the automated can height adjustment system 10, 10*a*, 10*b*. Additionally, while aluminum and steel cans are shown, other types of containers such as jars and bottles are also envisioned. Also, other washers 12 and dry-off ovens 14 are also envisioned.

TABLE 5

| Exemplary Cans | |
|---|---|
| Diameter | Height |
| 200 | 308 |
| 202 | 308 |
| 202 | 504 |
| 204 | 413 |
| 204 | 508 |
| 205 | 604 |
| 207 | 900 |
| 209 | 504 |
| 211 | 315 |
| 211 | 306 |
| 211 | 408 |
| 211 | 410.5 |
| 211 | 413 |
| 211 | 513 |
| 211 | 501 |
| 211 | 604 |
| 211 | 610 |
| 211 | 611 |
| 211 | 308 |
| 300 | 711 |
| 307 | 604 |
| 307 | 304 |
| 307 | 407 |

Figure 14:
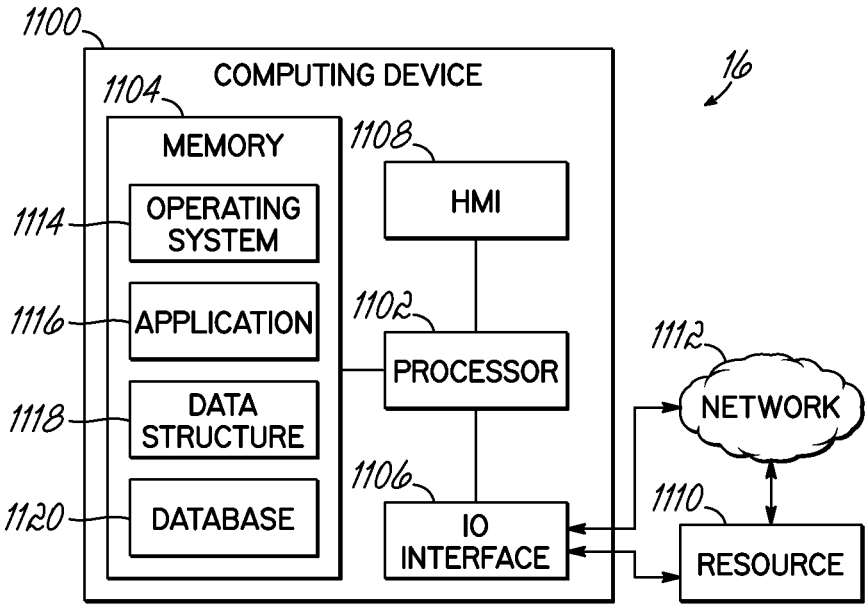
FIG. 14 shows a block diagram of the global controller.

Referring now to FIG. 14, embodiments of the global controller 16 described above, or portions thereof, may be implemented using one or more computer devices or systems, such as exemplary computer 1100. The computer 1100 may include a processor 1102, a memory 1104, an input/output (I/O) interface 1106, and a Human Machine Interface (HMI) 1108. The computer 1100 may also be operatively coupled to one or more external resources 1110 via the network 1112 and/or I/O interface 1106. External resources may include, but are not limited to, servers, databases, mass storage devices, peripheral devices, cloud-based network services, or any other resource that may be used by the computer 1100.

The processor 1102 may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in memory 1104. Memory 1104 may include a single memory device or a plurality of memory devices including, but not limited to, read-only memory (ROM), random access memory (RAM), volatile memory, non-volatile memory, static random access memory (SRAM), dynamic random access memory (DRAM), flash memory, cache memory, and/or data storage devices such as a hard drive, optical drive, tape drive, volatile or non-volatile solid state device, or any other device capable of storing data.

The processor 1102 may operate under the control of an operating system 1114 that resides in memory 1104. The operating system 1114 may manage computer resources so that computer program code embodied as one or more computer software applications, such as an application 1116 residing in memory 1104, may have instructions executed by the processor 1102. In an alternative embodiment, the processor 1102 may execute the application 1116 directly, in which case the operating system 1114 may be omitted. One or more data structures 1118 may also reside in memory 1104, and may be used by the processor 1102, operating system 1114, or application 1116 to store or manipulate data.

The I/O interface 1106 may provide a machine interface that operatively couples the processor 1102 to other devices and systems, such as the external resource 1110 or the network 1112. The application 1116 may thereby work cooperatively with the external resource 1110 or network 1112 by communicating via the I/O interface 1106 to provide the various features, functions, applications, processes, or modules comprising embodiments of the invention. The application 1116 may also have program code that is executed by one or more external resources 1110, or otherwise rely on functions or signals provided by other system or network components external to the computer 1100. Indeed, given the nearly endless hardware and software configurations possible, persons having ordinary skill in the art will understand that embodiments of the invention may include applications that are located externally to the computer 1100, distributed among multiple computers or other external resources 1110, or provided by computing resources (hardware and software) that are provided as a service over the network 1112, such as a cloud computing service.

The HMI 1108 may be operatively coupled to the processor 1102 of the computer 1100 in a known manner to allow a user to interact directly with the computer 1100. The HMI 1108 may include video or alphanumeric displays, a touch screen, a speaker, and any other suitable audio and visual indicators capable of providing data to the user. The HMI 1108 may also include input devices and controls such as an alphanumeric keyboard, a pointing device, keypads, pushbuttons, control knobs, microphones, etc., capable of accepting commands or input from the user and transmitting the entered input to the processor 1102.

A database 1120 may reside in memory 1104, and may be used to collect and organize data used by the various systems and modules described herein. The database 1120 may include data and supporting data structures that store and organize the data. In particular, the database 1120 may be arranged with any database organization or structure including, but not limited to, a relational database, a hierarchical database, a network database, or combinations thereof. A database management system in the form of a computer software application executing as instructions on the processor 1102 may be used to access the information or data stored in records of the database 1120 in response to a query, where a query may be dynamically determined and executed by the operating system 1114, other applications 1116, or one or more modules.

In general, the routines executed to implement the embodiments of the invention, whether implemented as part of an operating system or a specific application, component, program, object, module or sequence of instructions, or a subset thereof, may be referred to herein as "computer program code," or simply "program code." Program code typically comprises computer-readable instructions that are resident at various times in various memory and storage devices in a computer and that, when read and executed by one or more processors in a computer, cause that computer to perform the operations necessary to execute operations and/or elements embodying the various aspects of the embodiments of the invention. Computer-readable program instructions for carrying out operations of the embodiments of the invention may be, for example, assembly language or either source code or object code written in any combination of one or more programming languages.

Various program code described herein may be identified based upon the application within which it is implemented in specific embodiments of the invention. However, it should be appreciated that any particular program nomenclature which follows is used merely for convenience, and thus the invention should not be limited to use solely in any specific application identified and/or implied by such nomenclature. Furthermore, given the generally endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The program code embodied in any of the applications/modules described herein is capable of being individually or collectively distributed as a program product in a variety of different forms. In particular, the program code may be distributed using a computer-readable storage medium having computer-readable program instructions thereon for causing a processor to carry out aspects of the embodiments of the invention.

Computer-readable storage media, which is inherently non-transitory, may include volatile and non-volatile, and removable and non-removable tangible media implemented in any method or technology for storage of data, such as computer-readable instructions, data structures, program modules, or other data. Computer-readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired data and which can be read by a computer. A computer-readable storage medium should not be construed as transitory signals per se (e.g., radio waves or other propagating electromagnetic waves, electromagnetic waves propagating through a transmission media such as a waveguide, or electrical signals transmitted through a wire). Computer-readable program instructions may be downloaded to a computer, another type of programmable data processing apparatus, or another device from a computer-readable storage medium or to an external computer or external storage device via a network.

Computer-readable program instructions stored in a computer-readable medium may be used to direct a computer, other types of programmable data processing apparatuses, or other devices to function in a particular manner, such that the instructions stored in the computer-readable medium produce an article of manufacture including instructions that implement the functions, acts, and/or operations specified in the flow-charts, sequence diagrams, and/or block diagrams. The computer program instructions may be provided to one or more processors of a general purpose computer, a special purpose computer, or other programmable data processing apparatus to produce a machine, such that the instructions, which execute via the one or more processors, cause a series of computations to be performed to implement the functions, acts, and/or operations specified in the flow-charts, sequence diagrams, and/or block diagrams.

In certain alternative embodiments, the functions, acts, and/or operations specified in the flow-charts, sequence diagrams, and/or block diagrams may be re-ordered, processed serially, and/or processed concurrently consistent with embodiments of the invention. Moreover, any of the flow-charts, sequence diagrams, and/or block diagrams may include more or fewer blocks than those illustrated consistent with embodiments of the invention.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, actions, steps, operations, elements, and/or components, but do not preclude the presence or addition of one or more other features, integers, actions, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A method for adjusting the height of a can cleaning system using an automated can height adjustment system, the method comprising:

providing a first stage having a first stage height that is adjustable to accommodate at least a first can having a first can height and a second can having a second can height;

providing the automated can adjustment system that comprises a first drive mechanism configured to be operatively coupled with the first stage, a first height sensing device operatively coupled with the first drive mechanism, and a controller in communication with the first drive mechanism and the first height sensing device;

sensing a first stage height corresponding to the first can height using the first height sensing device;

generating first stage height information for the first stage corresponding to the first can height;

receiving the first stage height information corresponding to the first can height from the first height sensing device to the controller;

associating the first stage height information corresponding to the first can height with a first preset button;

recalling the first stage height information corresponding to the first can height by selecting the first preset button; and adjusting the first stage height based on the first stage height information corresponding to the first can height, wherein the controller instructs the first drive mechanism to adjust the first stage height to correspond to the first can height.

2. The method of claim 1, further comprising:

sensing a first stage height corresponding to the second can height using the first height sensing device;

generating first stage height information for the first stage corresponding to the second can height;

receiving the first stage height information corresponding to the second can height from the first height sensing device to the controller;

associating the first stage height information corresponding to the second can height with a second preset button;

recalling the first stage height information corresponding to the second can height by selecting the second present button; and adjusting the height of the first stage based on the first stage height information corresponding to the second can height, wherein the controller instructs the first drive mechanism to adjust the first stage height to correspond to the second can height.

3. The method of claim 1, further comprising:

providing a second stage having a second stage height that is adjustable to accommodate at least the first and second cans, providing a second drive mechanism configured to be operatively coupled with the second stage, a second height sensing device operatively coupled with the second drive mechanism, wherein the controller is also in communication with the second drive mechanisms and the second height sensing device;

sensing the second stage heights corresponding to the first can height using the first and second height sensing devices respectively;

generating second stage height information for the respective first and second stages corresponding to the first can height;

receiving the second stage height information corresponding to the first can height from the respective first and second height sensing devices to the controller;

associating the second stage height information corresponding the first can height with the first preset button;

recalling the second stage height information corresponding to the first can height by selecting the first preset button; and adjusting the second stage height based on the second stage height information corresponding to the first can height, wherein the controller instructs the second drive mechanisms to adjust second stage height to correspond to the first can height.

4. The method of claim 3, further comprising:

sensing the first and second stage height corresponding to the second can height using the first and second height sensing devices;

generating first and second stage height information for the respective first and second stage corresponding to the second can height;

receiving the first and second stage height information corresponding to the second can height from the first and second height sensing devices to the controller;

associating the first and second stage height information corresponding to the second can height with a second preset button;

recalling the first and second stage height information corresponding to the second can height by selecting the second present button; and adjusting the height of the first and second stage based on the respective first and second stage height information corresponding to the second can height, wherein the controller instructs the first and second drive mechanisms to adjust the respective first and second stage heights to correspond to the second can height.

5. The method of claim 4, further comprising:

providing a washer; and providing a dry-off oven;

wherein the washer includes the first stage and the dry-off oven includes the second stage.

* * * * *